US008662772B2

(12) United States Patent
Muir et al.

(10) Patent No.: US 8,662,772 B2
(45) Date of Patent: Mar. 4, 2014

(54) EDGE GUIDE FOR MEDIA TRANSPORT SYSTEM

(75) Inventors: Christopher M. Muir, Rochester, NY (US); Randy E. Armbruster, Rochester, NY (US); Ruth H. Parker, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 453 days.

(21) Appl. No.: 12/627,010

(22) Filed: Nov. 30, 2009

(65) Prior Publication Data

US 2011/0129278 A1 Jun. 2, 2011

(51) Int. Cl.
*B41J 13/26* (2006.01)
*B41J 13/30* (2006.01)

(52) U.S. Cl.
USPC ..... 400/633; 400/633.2; 400/630; 400/611; 226/15; 226/19

(58) Field of Classification Search
USPC ..... 400/633, 633.2, 630, 611, 583; 271/9.1; 226/15, 19, 20, 1; 101/485, 486; 399/384
See application file for complete search history.

(56) References Cited

U.S. PATENT DOCUMENTS

| | | | | |
|---|---|---|---|---|
| 3,119,534 | A * | 1/1964 | Lehnert | 226/1 |
| 3,443,273 | A | 5/1969 | Arch | |
| 3,831,831 | A | 8/1974 | Flippen, Jr. et al. | |
| 3,850,358 | A | 11/1974 | Nettles | |
| 4,349,849 | A * | 9/1982 | Satoh | 360/71 |
| 4,572,417 | A | 2/1986 | Joseph et al. | |
| 4,795,070 | A | 1/1989 | Blanding et al. | |
| 4,901,903 | A | 2/1990 | Blanding | |
| 5,360,152 | A * | 11/1994 | Matoushek | 242/615.12 |
| 5,397,289 | A | 3/1995 | Entz et al. | |
| 5,865,021 | A * | 2/1999 | Duerigen et al. | 59/4 |
| 6,370,351 | B1 * | 4/2002 | Puritscher et al. | 399/313 |
| 6,880,458 | B2 * | 4/2005 | Munz et al. | 101/211 |
| 2004/0055491 | A1 | 3/2004 | Munz et al. | |
| 2007/0065216 | A1 | 3/2007 | Hamaba et al. | |
| 2009/0122126 | A1 | 5/2009 | Ray et al. | |

FOREIGN PATENT DOCUMENTS

| | | | |
|---|---|---|---|
| DE | 3533275 | A1 * | 3/1987 |
| DE | 197 49 605 | A1 | 5/1999 |
| DE | 297 24 361 | U1 | 2/2001 |
| EP | 0 307 125 | A2 | 3/1989 |
| EP | 0 562 228 | A2 | 9/1993 |
| EP | 0 491 475 | | 2/1996 |
| GB | 2 191 472 | A | 12/1987 |

* cited by examiner

*Primary Examiner* — Matthew G Marini
(74) *Attorney, Agent, or Firm* — William R. Zimmerli

(57) ABSTRACT

An edge guide is provided. A structure includes curved surface over which a print media can travel. The print media includes a first edge and a second edge that is opposite the first edge. A first media guide is contactable with the first edge of the print media. A second media guide is contactable with the second edge of the print media. The second media guide is spaced apart from the first media guide. A relative spacing between the second media guide and the first media guide is adjustable such that a distance between the first media guide and the second media guide is variable. The second media guide includes a mechanism that applies a nesting force to the second edge of the print media to cause the first edge of the print media to move toward and contact the first media guide.

31 Claims, 24 Drawing Sheets

EDGE GUIDE FOR MEDIA TRANSPORT SYSTEM

CROSS REFERENCE TO RELATED APPLICATIONS

Reference is made to commonly-assigned copending U.S. patent application Ser. No. 12/627,032 filed Nov. 30, 2009 entitled "MODULAR MEDIA TRANSPORT SYSTEM", by DeCook et al.; to commonly-assigned copending U.S. patent application Ser. No. 12/627,018 filed Nov. 30, 2009 entitled "MEDIA TRANSPORT SYSTEM FOR NON-CONTACTING PRINTING" by Muir et al.; and to commonly-assigned copending U.S. patent application Ser. No. 12/627,037 entitled "EDGE GUIDE HAVING ADJUSTABLE MAGNITUDE NESTING FORCE" by Muir et al.

FIELD OF THE INVENTION

The present invention generally relates to printing apparatus for web media and more particularly relates to an edge guide for a web media transport apparatus that supports kinematic web handling for feeding a continuous web of media from a supply and to one or more printing sections.

BACKGROUND OF THE INVENTION

Continuous web printing allows economical, high-speed, high-volume print reproduction. In this type of printing, a continuous web of paper or other substrate material is fed past one or more printing subsystems that form images by applying one or more colorants onto the substrate surface. In a conventional web-fed rotary press, for example, a web substrate is fed through one or more impression cylinders that perform contact printing, transferring ink from an imaging roller onto the web in a continuous manner.

Proper registration of the substrate to the printing device is of considerable importance in print reproduction, particularly where multiple colors are used in four-color printing and similar applications. Conventional web transport systems in today's commercial offset printers address the problem of web registration with high-precision alignment of machine elements. Typical of conventional web handling subsystems are heavy frame structures, precision-designed components, and complex and costly alignment procedures for precisely adjusting substrate transport between components and subsystems.

The problem of maintaining precise and repeatable web registration and transport becomes even more acute with the development of high-resolution non-contact printing, such as high-volume inkjet printing. With this type of printing system, finely controlled dots of ink are rapidly and accurately propelled from the printhead onto the surface of the moving media, with the web substrate often coursing past the printhead at speeds measured in hundreds of feet per minute. No impression roller is used; synchronization and timing are employed to determine the sequencing of colorant application to the moving media. With dot resolution of 600 dots-per-inch (DPI) and better, a high degree of registration accuracy is needed. During printing, variable amounts of ink may be applied to different portions of the rapidly moving web, with drying mechanisms typically employed after each printhead or bank of printheads. Variability in ink or other liquid amounts and types and in drying time can cause substrate stiffness and tension characteristics to vary dynamically over a range for different types of substrate, contributing to the overall complexity of the substrate handling and registration challenge.

One approach to the registration problem is to provide a print module that forces the web media along a tightly controlled print path. This is the approach that is exemplified in U.S. Patent Application No. 2009/0122126 entitled "Web Flow Path" by Ray et al. In such a system, there are multiple drive rollers that fix and constrain the web media position as it moves past one or more ink application printheads.

Problems with such a conventional approach include significant cost in design, assembly, and adjustment and alignment of web handling components along the media path. While such a conventional approach may allow some degree of modularity, it would be difficult and costly to expand or modify a system with this type of design. Each "module" for such a system would itself be a complete printing apparatus, or would require a complete, self-contained subassembly for paper transport, making it costly to modify or extend a printing operation, such as to add one or more additional colors or processing steps, for example.

Various approaches to web tracking are suitable for various printing technologies. For example, active alignment steering, as taught for an electrographic reproduction web (often referred to as a belt on which images are transported) in commonly assigned U.S. Pat. No. 4,572,417 entitled "Web Tracking Apparatus" to Joseph et al. would require multiple steering stations for continuous web printing, with accompanying synchronization control. It would be difficult and costly to employ such a solution with a print medium whose stiffness and tension vary during printing, as described above. Other solutions for web (or belt as referred to above) steering are similarly intended for endless webs in electrophotographic equipment but are not readily adaptable for use with paper media. Steering using a surface-contacting roller, useful for low-speed photographic printers and taught in commonly assigned U.S. Pat. No. 4,795,070 entitled "Web Tracking Apparatus" to Blanding et al. would be inappropriate for a surface that is variably wetted with ink and would also tend to introduce non-uniform tension in the cross-track direction. Other solutions taught for photographic media, such as those disclosed in commonly assigned U.S. Pat. No. 4,901,903 entitled "Web Guiding Apparatus" to Blanding are well suited to photographic media moving at slow to moderate speeds but are inappropriate for systems that need to accommodate a wide range of medias, each with different characteristics, and transport each media type at speeds of hundreds of feet per minute.

In order for high-speed non-contact printers to compete against earlier types of devices in the commercial printing market, the high cost of the web transport must be greatly reduced. There is a need for an adaptable non-contact printing system that can be fabricated and configured without the cost of significant down-time, complex adjustment, and constraint on web media materials and types.

One aspect of such a system relates to components that feed the continuous web substrate into the printing system and guide the web media into a suitable cross-track position for subsequent transport and printing. Conventional solutions for controlling the position of a moving web include approaches used for handling magnetic tape media used for data storage. For example, U.S. Pat. No. 3,443,273 entitled "Tape Handling Element" to Arch describes a roller mechanism that guides tape position by applying force that continuously aligns an edge of the moving tape with an edge-guiding cap on the roller; U.S. Pat. No. 3,850,358 entitled "Continuous Compliant Guide for Moving Web" to Nettles describes an arrangement of long, continuous compliant guides that register one or both sides of the moving magnetic tape; European Patent Application EP 0 491 475 entitled "Flexible Moving Web Guide" by Albrecht et al. describes a gimbaled compliant tape guide that employs a flanged roller for guiding the moving magnetic tape.

While conventional solutions such as these may work successfully for magnetic tape, however, these approaches fail to meet the needs of a print media handing system. Magnetic tape has a fixed size and confined stiffness range, unlike paper and other printing substrates, and magnetic tape thus presents a simpler mechanical task for maintaining constant tension and precise registration as it moves past read/write components. Close spacing between edge guides is possible with magnetic tape, allowing precise registration at high transport speeds; however, with paper and other print substrates, dimensional requirements make such tight control unworkable using closely spaced edge guides.

Conventional solutions for handling continuous web print media have also been found to be poorly suited for high-speed non-contact printing applications. For example, commonly assigned U.S. Pat. No. 5,397,289 entitled "Gimballed Roller for Web Material" to Entz et al. describes a gimbaled roller that positions itself automatically with respect to a moving web, but applies edge guidance along both edges, providing over-constraint not desirable for a kinematic web handling system. The '903 Blanding patent noted earlier describes the use of a compliant roller with a pivoted yoke and roller that urges an edge of the moving web of photographic print paper against an edge guide as it is fed from a supply roll. This type of solution works well for photographic paper, which has a relatively high cross-track stiffness and relatively narrow range of widths, but is not readily adaptable for print media that can be several times as wide as photographic print paper and, unlike photographic media, may have a broad range of stiffness and thickness characteristics.

The task of guiding a web into position within a printer has been traditionally done with a servo web guide or nipped edge guide assembly. Among problems with conventional web guides of these types are high parts count and assembly cost, complex mechanical constraint profiles, media handling problems due to localized nip pressure, and relatively high cost. Depending on the application, a traditional edge guide, such as those previously described in the literature, may have other shortcomings as well. Many conventional edge guide devices contact the top surface of the paper or other substrate with an "urging" roller that urges the paper against an edge guide. This can transmit a force through the paper onto the web support means, potentially damaging the web or smudging any colorant or other coating that may already be imprinted on the web surface. A conventional urging roller can also place a non-uniform drag on the paper due to a force imbalance between the edge and nip forces. It can also be difficult to accommodate large variations in paper width while maintaining center justification with this approach.

Among desirable characteristics of the input subsystem for web guidance are the following:

(i) accommodate a range of media widths and media having different stiffness, thickness, surface gloss, and other characteristics;

(ii) maintain center justification of the media web as it travels through the transport system; center justification is needed for kinematic web handling;

(iii) minimize parts count, mechanical complexity, and cost;

(iv) eliminate the need for an urging roller that applies force against the printed surface of the media web;

(v) eliminate point contact against the edge of the web;

(vi) able to accept input media from a slack loop, wherein the media upon input has very little cross-web stiffness, and to provide media being fed downstream, such as into a printing apparatus, with a higher amount of cross-web stiffness;

(vii) minimize mechanical constraint to the web as much as possible.

Unfortunately, performance problems that may be inherent to various types of conventional web media edge guides and may not impact some types of systems become increasingly more pronounced as web transport speeds increase. While problems such as non-uniform drag and tendency to stray from center justification can be corrected to some degree with slower moving web transport systems, these problems are accentuated where high web transport speeds exceed 100 feet per minute. Difficulties of this type become even further complicated when system requirements allow for a range of media widths and types, having various stiffness, thickness, surface smoothness, and other characteristics, and when some of these characteristics can change dynamically, such as with the amount of applied ink or other fluids. There is, then, a need for a web edge guide that is suited to the demanding requirements of high-speed media transport for non-contact printing applications.

SUMMARY OF THE INVENTION

It is an object of the present invention to advance the art of continuous web media handling. With this object in mind, the present invention provides an edge guide that supports kinematic handling and transport of a continuous web print media.

According to one aspect of the present invention, an edge guide is provided. A structure includes curved surface over which a print media can travel. The print media includes a first edge and a second edge that is opposite the first edge. A first media guide is contactable with the first edge of the print media. A second media guide is contactable with the second edge of the print media. The second media guide is spaced apart from the first media guide. A relative spacing between the second media guide and the first media guide is adjustable such that a distance between the first media guide and the second media guide is variable. The second media guide includes a mechanism that applies a nesting force to the second edge of the print media to cause the first edge of the print media to move toward and contact the first media guide.

According to another aspect of the present invention, a method of printing on a continuous web of print media includes providing an edge guide structure including: a curved surface over which a print media can travel, the print media including a first edge and a second edge that is opposite the first edge; a first media guide that is contactable with the first edge of the print media; a second media guide that is contactable with the second edge of the print media, the second media guide being spaced apart from the first media guide, a relative spacing between the second media guide and the first media guide being variable; optionally adjusting the relative spacing between the second media guide and the first media guide to accommodate the print media; causing the print media to travel through the edge guide structure; and applying a nesting force to the second edge of the print media to cause the first edge of the print media to move toward and contact the first media guide using a mechanism associated with the second media guide as the print media travels through the structure.

Embodiments of the present invention advantageously provide an edge guide that accommodates a range of media widths, thicknesses, stiffness, and other characteristics. The edge guide of the present invention minimizes mechanical constraints to the moving web, maintaining center justification in the cross-track direction, with continuous alignment of an edge of the media during transport.

Another advantage of the present invention is that it supports self-alignment of web media transport components to the continuously moving web in order to maintain registration of the printing media. The present invention also allows non-contact printing or, more generally, application of fluids, onto the media surface at high speeds, without applying an over-constraining force or pressure that might inadvertently damage the media, cause image misregistration, or otherwise inhibit proper drying or curing of applied inks and other fluids.

The invention and its objects and advantages will become more apparent in the detailed description of the example embodiments presented below. The invention is defined by the claims.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
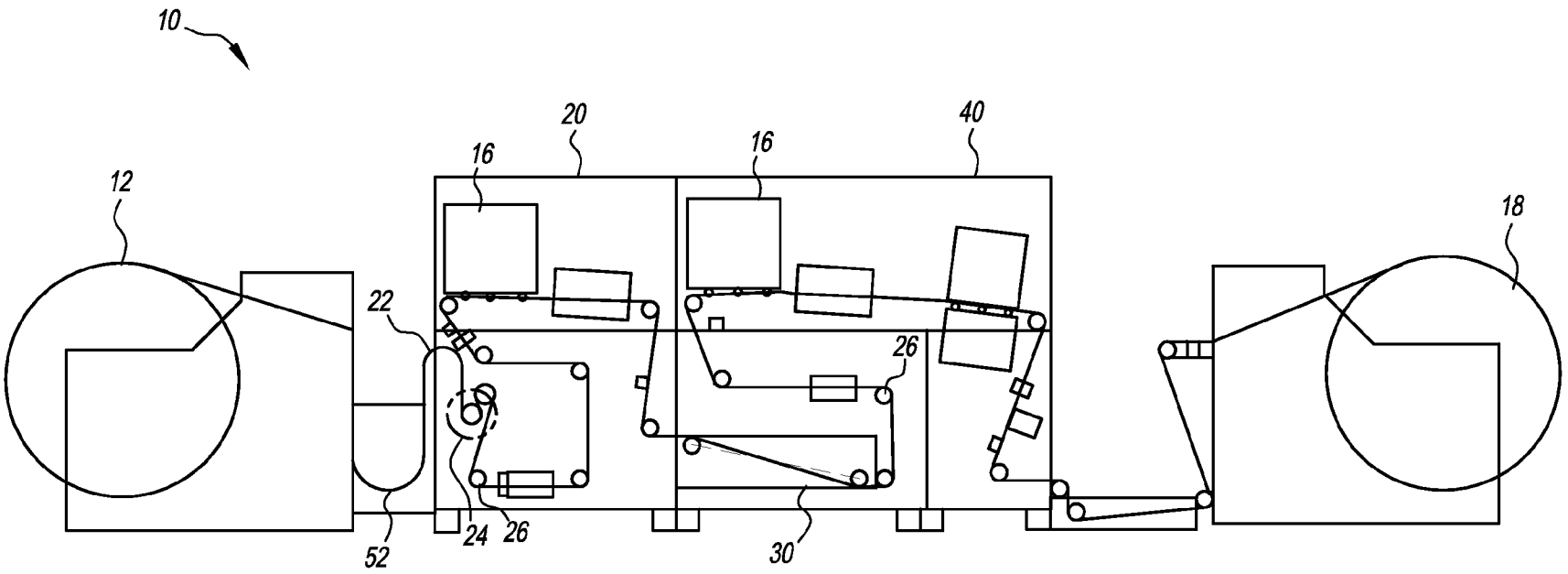
FIG. 1 is a schematic side view of a digital printing system according to an example embodiment of the present invention.

The present description will be directed in particular to elements forming part of, or cooperating more directly with, apparatus in accordance with the present invention. It is to be understood that elements not specifically shown or described may take various forms well known to those skilled in the art.

The method and apparatus of the present invention provide a modular approach to the design of a digital printing system, utilizing features and principles of exact constraint for transporting continuously moving web print media past one or more digital printheads, such as inkjet printheads. The apparatus and method of the present invention are particularly well suited for printing apparatus that provide non-contact application of ink or other colorant onto a continuously moving medium. The printhead of the present invention selectively moistens at least some portion of the media as it courses through the printing system, but without the need to make contact with the print media.

In the context of the present disclosure, the term "continuous web of print media" relates to a print media that is in the form of a continuous strip of media as it passes through the printing system from an entrance to an exit thereof. The continuous web of print media itself serves as the receiving print medium to which one or more printing ink or inks or other coating liquids are applied in non-contact fashion. This is distinguished from various types of "continuous webs" or "belts" that are actually transport system components rather than receiving print media and that are typically used to transport a cut sheet medium in an electrophotographic or other printing system. The terms "upstream" and "downstream" are terms of art referring to relative positions along the transport path of a moving web; points on the web move from upstream to downstream. Where they are used, the terms "first", "second", and so on, do not necessarily denote any ordinal or priority relation, but are simply used to more clearly distinguish one element from another.

Kinematic web handling is provided not only within each module of the system of the present invention, but also at the interconnections between modules, as the continuously moving web medium passes from one module to another. Unlike a number of conventional continuous web imaging systems, the apparatus of the present invention does not require a slack loop between modules, but typically uses a slack loop only for media that has been just removed from the supply roll at the input end. Removing the need for a slack loop between modules or within a module allows addition of a module at any position along the continuously moving web, taking advantage of the self-positioning and self-correcting design of media path components.

The apparatus and methods of the present invention adapt a number of exact constraint principles to the problem of web handling. As part of this adaptation, the inventors have identified ways to allow the moving web to maintain proper cross-track registration in a "passive" manner, with a measure of self-correction for web alignment. Steering of the web is avoided unless absolutely necessary; instead, the web's lateral and angular positions in the plane of transport are exactly constrained. Moreover, other web support devices used in transporting the web, other than non-rotating surfaces or those devices purposefully used to exactly constrain the web, are allowed to self-align with the web. The digital printing system according to this invention includes one or more modules that guide the web of print media as it passes at least one non-contact digital printhead. The digital printing system can also include components for drying or curing of the printing fluid on the media; for inspection of the media, for example, to monitor and control print quality; and various other functions. The digital printing system receives the print media from a media source, and after acting on the print media conveys it to a media receiving unit. The print media is maintained under tension as it passes through the digital printing system, but it is not under tension as it is received from the media source.

Referring to the schematic side view of FIG. 1, there is shown a digital printing system 10 for continuous web printing according to one embodiment. A first module 20 and a second module 40 are provided for guiding continuous web media that originates from a source roller 12. Following an initial slack loop 52, the media that is fed from source roller 12 is then directed through digital printing system 10, past one or more digital printheads 16 and supporting printing system 10 components. First module 20 has a support structure, shown in more detail subsequently, that includes a cross-track positioning mechanism 22 for positioning the continuously moving web of print media in the cross-track direction, that is, orthogonal to the direction of travel and in the plane of travel. In one embodiment, cross-track positioning mechanism 22 is an edge guide for registering an edge of the moving media. A tensioning mechanism 24, affixed to the support structure of first module 20, includes structure that sets the tension of the print media.

Downstream from first module 20 along the path of the continuous web media, second module 40 also has a support structure, similar to the support structure for first module 20. Affixed to the support structure of either or both the first or second module 20 or 40 is a kinematic connection mechanism that maintains the kinematic dynamics of the continuous web of print media in traveling from the first module 20 into the second module 40. Also affixed to the support structure of either the first or second module 20 or 40 are one or more angular constraint structures 26 for setting an angular trajectory of the web media.

Still referring to FIG. 1, printing system 10 optionally also includes a turnover mechanism 30 that is configured to turn the media over, flipping it backside-up in order to allow printing on the reverse side. The print media then leaves the digital printing system 10 and travels to a media receiving unit, in this case a take-up roll 18. A take-up roll 18 is then formed, rewound from the printed web media. The digital printing system can include a number of other components, including multiple print heads and dryers, for example, as described in more detail subsequently. Other examples of system components include web cleaners, web tension sensors, and quality control sensors.

Figure 2A:
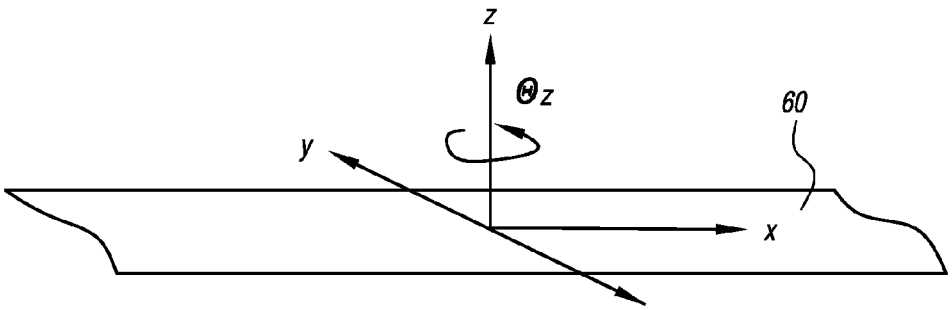
FIG. 2A is a perspective view showing an orthogonal coordinate system used to characterize web media constraints.

FIG. 2A shows a perspective view of a portion of the web path with orthogonal coordinates used herein to describe principles of web constraint. A moving web 60 is considered to be unconstrained in the x direction. Cross-track y direction is considered orthogonal to the x direction. Angular trajectory is described in terms of $\theta z$, rotation about the orthogonal z axis.

Figure 2B:
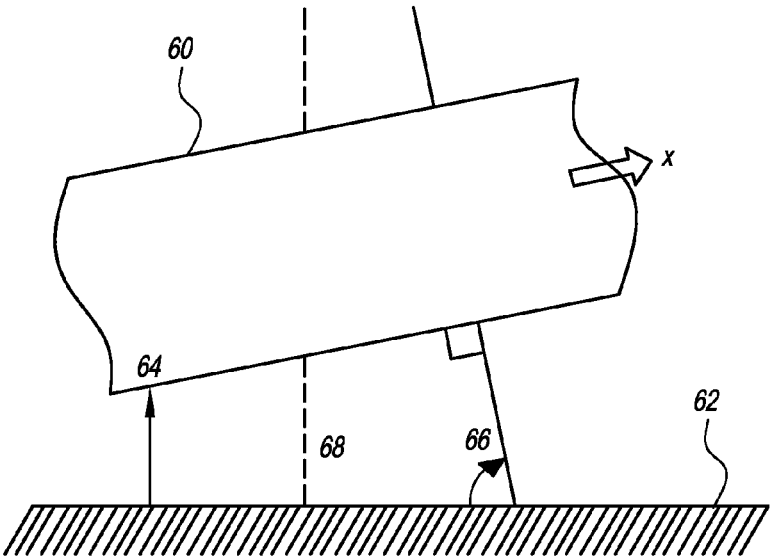
FIG. 2B is a schematic top view showing angular and lateral constraints applied to a continuously moving web.

FIG. 2B shows, in a schematic top view, symbols for exact constraint principles that are applied to a continuously moving web and are used for the apparatus and methods of the present invention. This type of drawing is commonly referred to as a web plane diagram. Moving web 60 is shown deliberately skewed with respect to the web support structure 62. A lateral constraint is denoted by an arrow from the web support structure 62 that contacts the edge of the moving web as shown at 64. An angular constraint is denoted by a solid line from the web support structure 62 that spans the web and is perpendicular to the web shown at 66. A support that provides no lateral or angular constraint on the web passing over it is denoted by a dashed line from the web support structure 62 that crosses the web at a non-perpendicular angle as shown at 68. This figure shows a combination of an upstream lateral constraint (64) and a downstream angular constraint (66) that is useful for providing a stable constraint condition. A number of related principles have also been found useful for maintaining exact constraint: These include the following:

(i) Web 60 tends to approach a roller at a 90 degree angle, as shown in FIG. 2B by the orthogonal symbol along the edge of web 60 at angular constraint 66.

(ii) Stationary curved surfaces impart no measurable cross-track force onto a moving web passing over it, and can be denoted by the dashed line as at 68.

(iii) Castered rollers allow the roller to rotate so that it is at a 90 degree angle to the approaching web. These also can be denoted in the web plane diagram as a dashed line as at 68.

(iii) Gimbaled rollers allow the web to maintain its preferred 90 degree angle approach and orientation to the next downstream roller along the web path. This is because the web exhibits considerable flexibility in twist. Since the gimbaled roller provides the flexibility needed for the web to align with the following roller, they are illustrated in web plane diagrams as a pivot allowing adjacent spans to have differing angles relative to the web support structure. At the same time, gimbaled rollers can be used to provide an angular constraint as the web approaches the gimbaled roller at a 90 degree angle.

(iv) Castered rollers can be used where it is desirable to impart no lateral or angular constraint to the moving web.

(v) Two edge guides within the same web span provide both lateral and angular constraint.

Within the printing apparatus of the present invention, the web is guided along its transport path through a number of rollers and curved surfaces. For each web span, both lateral constraint 64 and angular constraint 66 are necessary. However, adding an additional mechanism to achieve lateral or angular constraint can easily cause an over-constraint condition. Thus, for each web span that follows an initial lateral constraint along the web path, the constraint method employed by the inventors attempts to use, as its lateral "constraint", the given cross track position of the web as it is received from the preceding web span.

Over each web span, then, an angular constraint is provided by a roller mechanism, as described in more detail subsequently. Not every roller along the web path applies angular constraint; in many cases it is advantageous to provide a castered roller or a stationary curved surface that is arranged to provide zero constraint.

Following principles such as these, the inventors have found that an arrangement of mechanisms can be provided to yield the stable constraint arrangement described with respect to FIG. 2B over each web span, so that web 60 itself maintains lateral position without external steering or other applied force. In addition, these same mechanisms operable at the interface of one web span to the next also apply at the interface as the web passes between one module and the next.

Figure 3:
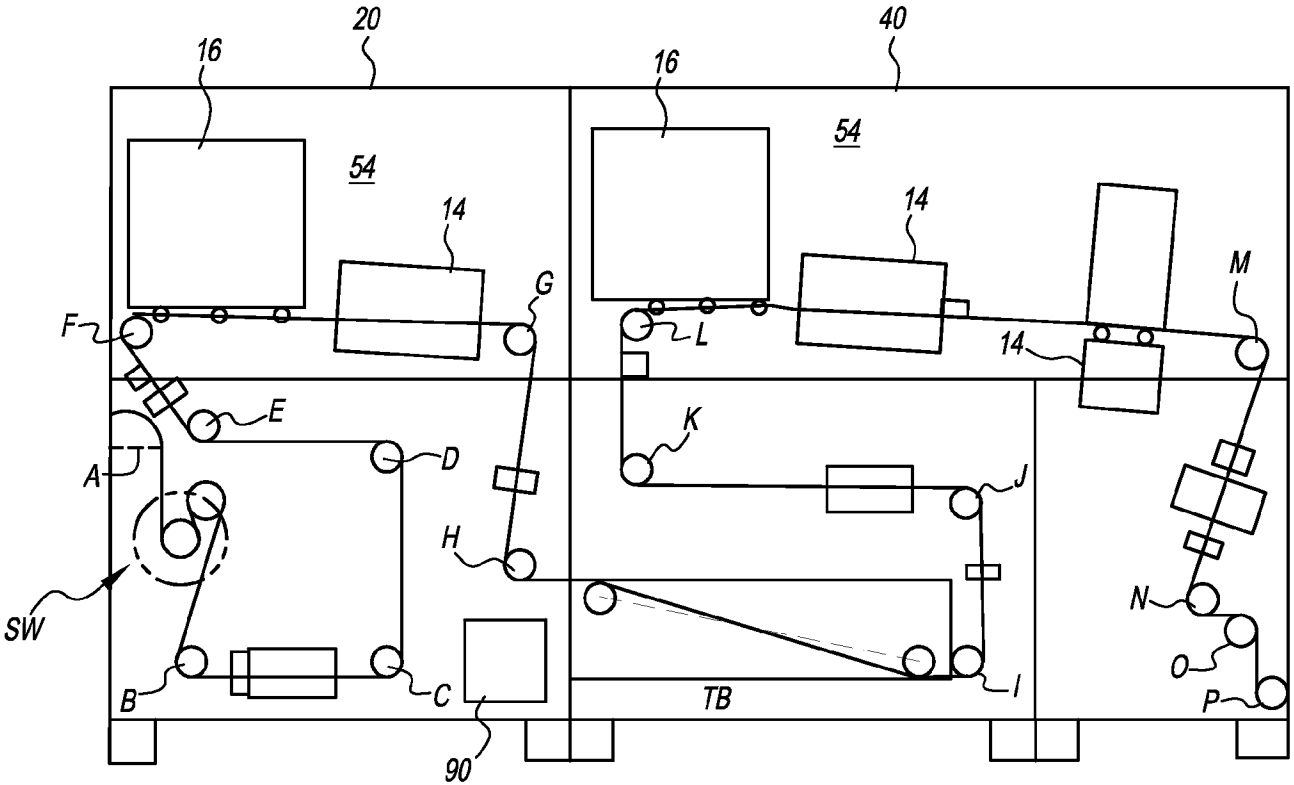
FIG. 3 is an enlarged schematic side view of media transport components of the digital printing system shown in FIG. 1.

The schematic side view diagram of FIG. 3 shows, at enlarged scale from that of FIG. 1, the media routing path through modules 20 and 40 in one embodiment. Within each module 20 and 40, in a print zone 54, each print head 16 is followed by a dryer 34.

Table 1 that follows identifies the lettered components used for web media transport and shown in FIG. 3. An edge guide in which the media is pushed laterally so that an edge of the media contacts a stop is provided at A. The slack web entering the edge guide allows the print media to be shifted laterally without interference without being overconstrained. An S-wrap device SW provides stationary curved surfaces over which the continuous web slides during transport. As the paper is pulled over these surfaces the friction of the paper across these surfaces produces tension in the print media. In one embodiment, this device allows an adjustment of the positional relationship between surfaces, to control the angle of wrap and allow adjustment of web tension.

TABLE 1

Roller Listing for FIG. 3

| Media Handling Component | Type of Component |
|---|---|
| A | Lateral constraint (edge guide) |
| SW - S-Wrap | Zero constraint (non-rotating support). Tensioning. |
| B | Angular constraint (in-feed drive roller) |
| C | Zero constraint (Castered and Gimbaled Roller) |
| D* | Angular constraint with hinge (Gimbaled Roller) |
| E | Angular constraint with hinge (Gimbaled Roller) |
| F | Angular constraint (Fixed Roller) |
| G | Zero constraint (Castered and Gimbaled Roller) |
| H | Angular constraint with hinge (Gimbaled Roller) |
| TB (TURNOVER) | See FIG. 4 |
| I | Zero constraint (Castered and Gimbaled Roller) |
| J* | Angular constraint with hinge (Gimbaled Roller) |
| K | Angular constraint with hinge (Gimbaled Roller) |
| L | Angular constraint (Fixed Roller) |
| M | Zero constraint (Castered and Gimbaled Roller) |
| N | Angular constraint (out-feed drive roller) |
| O | Zero constraint (Castered and Gimbaled Roller) |
| P | Angular constraint with hinge (Gimbaled Roller) |

Note:
Asterisk (*) indicates locations of load cells.

The first angular constraint is provided by in-feed drive roller B. This is a fixed roller that cooperates with a drive roller in the turnover section and with an out-feed drive roller N in second module 40 in order to move the web through the printing system with suitable tension in the movement direction (x-direction). The tension provided by the preceding S-wrap serves to hold the paper against the in-feed drive roll so that a nip roller is not required at the drive roller. Angular constraints at subsequent locations downstream along the web are often provided by rollers that are gimbaled so as not to impose an angular constraint on the next downstream web span.

Figure 4:
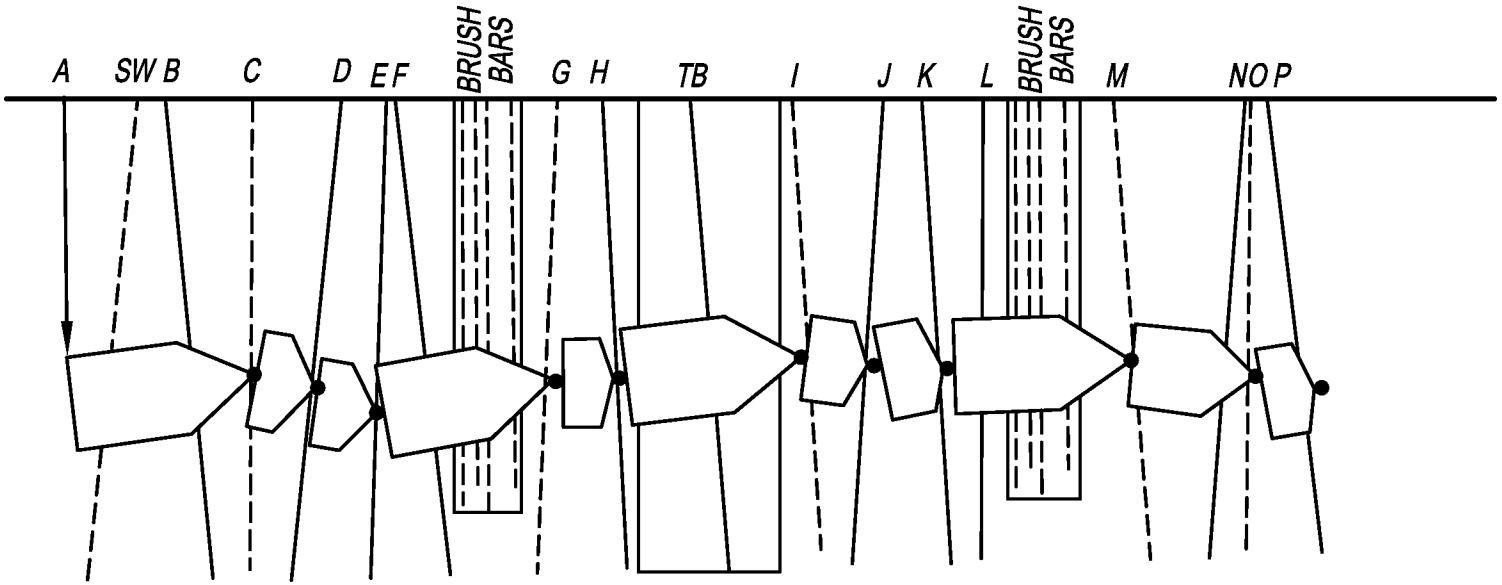
FIG. 4 is a web plane diagram for the web transport path of the digital printing system shown in FIG. 3.

The web plane diagram of FIG. 4 schematically shows where various constraints are imposed along the media path shown in the side view of FIG. 3. The following notes help to interpret the diagram of FIG. 4 and to relate this schematic representation to the component arrangement shown in FIG. 3:

(i) There is a single lateral constraint mechanism used at A. Here, at the beginning of the media path, a single edge guide provides lateral constraint that is sufficient for registering the continuous web of print media along the media path. It is significant that only one lateral constraint is actively applied throughout the media path, here, as an edge guide. However, given this lateral constraint and the following angular constraint, the lateral constraint for each subsequent web span can be fixed. In one embodiment, a gentle additional force is applied along the cross-track direction as an aid for urging the media edge against the edge guide at A. This force is often referred to as a nesting force as the force helps cause the edge of the media to nest along side the edge guide.

(ii) Angular constraints are imposed onto the web path wherever there are solid lines shown across the web in the web plane diagram. Each angular constraint sets the angular trajectory of the web as it moves along. However, the web is not otherwise steered in the embodiment shown.

(iii) Fixed rollers at F and L precede the printheads for each module, providing the desired angular constraint to the web in the print zone. These rollers provide a suitable location of mounting an encoder for monitoring the motion of the media through the printing system.

(iv) Under the printheads, the print media is supported by fixed non-rotating supports. These supports provide zero constraint to the web.

(v) Roller G is a castered and gimbaled roller providing zero constraint. In FIG. 4, dashed lines indicate mechanisms that provide zero constraint, such as where stationary curved surfaces or castered rollers are used.

(vi) If the span between roller F and 0 is sufficiently long, the continuous web may lack sufficient stiffness to cause castered roller G to align properly with the web. In such cases, roller G need not be castered. Because of the relative length to width ratio of the media in the segment between F and G, the continuous web in that segment is considered to be non-stiff, showing some degree of compliance in the cross-track direction. As a result, an additional constraint can be included to exactly constrain that web segment. This can be accomplished by eliminating the caster from roller G.

(vii) Each discrete section between pivots of the web plane diagram represents a web span. As noted, in the recommended practice for exact constraint web handling design, each web span should align properly if it has exactly one lateral and one angular constraint. For most of the web spans, the exit lateral position of the previous or nearest upstream web span sets the lateral position of the web at the entrance to the next web span. Where needed, because ideal exact constraint is difficult to apply over every web span, an active steering mechanism can be used to determine lateral constraint.

(viii) Castered and gimbaled rollers provide zero constraint along the web path. These mechanisms are used, for example, near the input to each module, making each module independent of angular constraints from earlier mechanisms.

(ix) Axially compliant rollers could alternately be used where cross-track constraint is undesirable.

Figure 10:
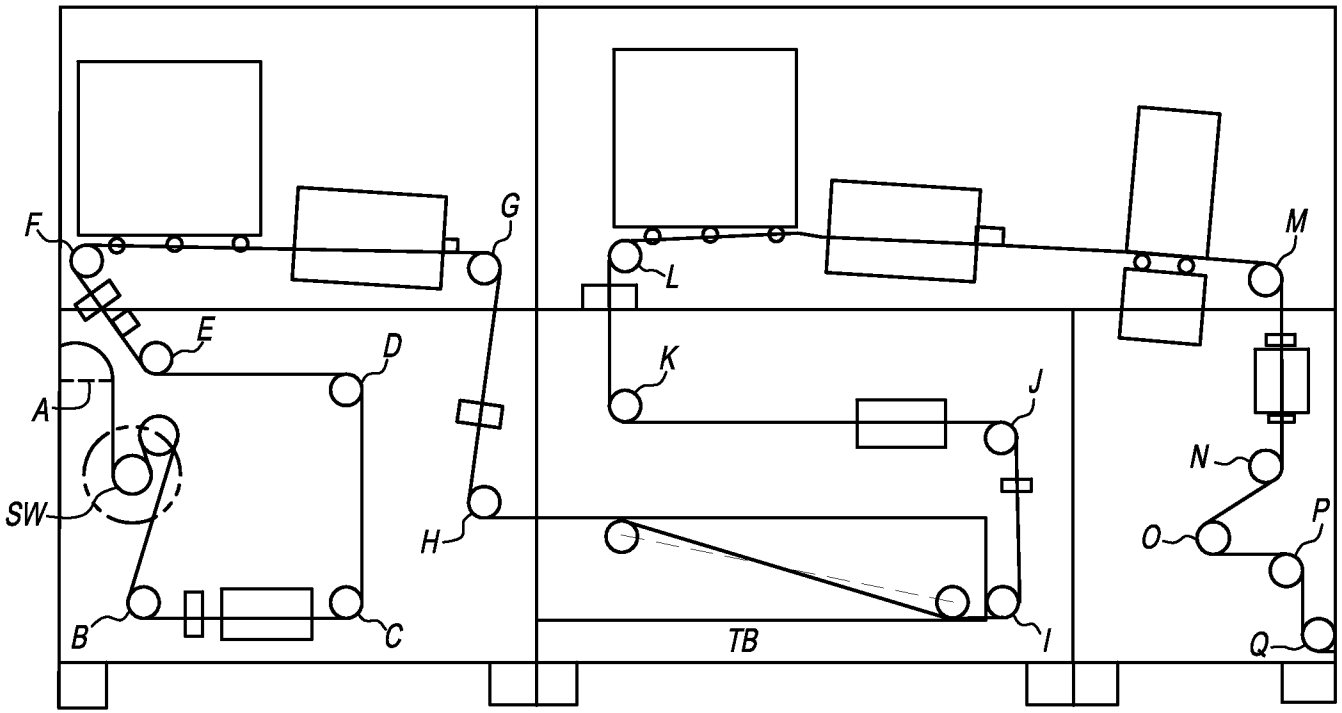
FIG. 10 is a schematic side view of a digital printing system according to another example embodiment of the present invention.
Figure 11:
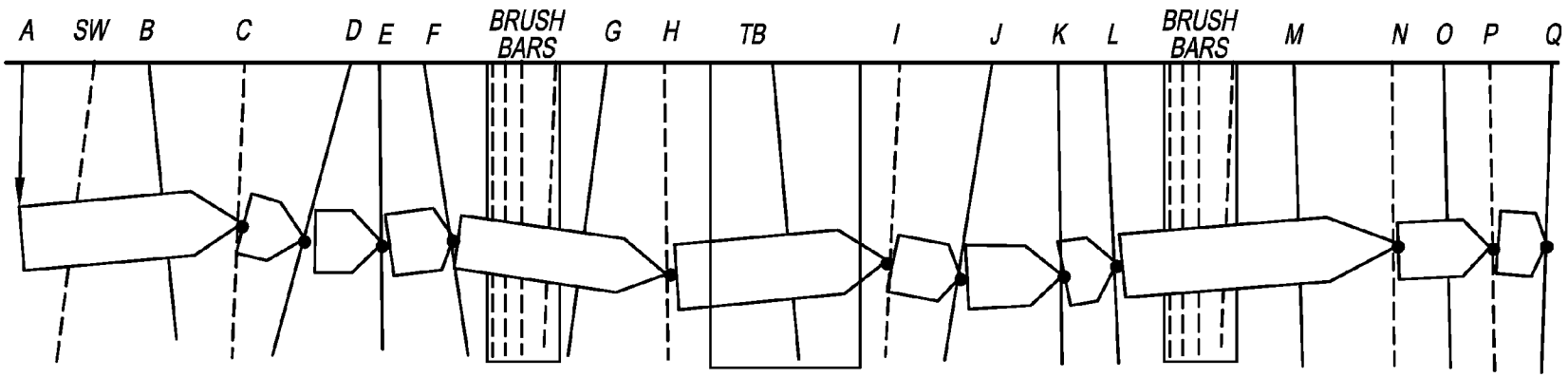
FIG. 11 is a web plane diagram for the web transport path of the digital printing system shown in FIG. 10.

Table 2 that follows identifies the lettered components used for an alternative embodiment of the web media transport shown in FIG. 10. The web plane diagram of FIG. 11 schematically shows where various constraints are imposed along the media path and corresponds to the embodiment shown in FIG. 10.

TABLE 2

Roller Listing for FIG. 10

| Media Handling Component | Type of Component |
|---|---|
| A | Lateral constraint (edge guide) |
| SW - S-Wrap | Zero constraint (non-rotating support). Tensioning. |
| B | Angular constraint (in-feed drive roller) |
| C | Zero constraint (Castered and Gimbaled Roller) |
| D* | Angular constraint with hinge (Gimbaled Roller) |
| E | Angular constraint with hinge (Gimbaled Roller) |
| F | Angular constraint with hinge (Gimbaled Roller) |
| G | Angular constraint (Fixed Roller) |
| H | Zero constraint (Castered and Gimbaled Roller) |
| TB (TURNOVER) | See FIG. 4 |
| I | Zero constraint (Castered and Gimbaled Roller) |
| J* | Angular constraint with hinge (Gimbaled Roller) |
| K | Angular constraint with hinge (Gimbaled Roller) |
| L | Angular constraint with hinge (Gimbaled Roller) |
| M | Angular constraint (Fixed Roller) |
| N | Zero constraint (Castered and Gimbaled Roller) |
| O | Angular constraint (out-feed drive roller) |
| P | Zero constraint (Castered and Gimbaled Roller) |
| Q | Angular constraint with hinge (Gimbaled Roller) |

Note:
Asterisk (*) indicates locations of load cells.

In this embodiment, an angular constraining fixed roller has been located at G, immediately after the print zone containing the printhead 16 and dryer 34, rather than in location F immediately preceding the printhead as in the first embodiment. To eliminate an over constraint condition in the span from roller F to G, fixed roller F of the previous configuration has been replaced with a gimbaled roller. In a similar manner the angular constraining fixed roller has been moved from location L to location M. This places the angular constraint on the print media in the print zone immediately after printhead 16. To eliminate an over-constraint condition in this configuration between the fixed roller M and the fixed drive roller O, a zero constraint castered and gimbaled roller N has been placed between those two fixed rollers.

In either the first or the second embodiment, the angular orientation of the print media in the print zone containing one or more printheads and possibly one or more dryers is controlled by a roller placed immediately before or immediately after the print zone. This is critical for ensuring registration of the print from multiple printheads. It is also critical that the web not be overconstrained in the print zone. This has been done by placing a constraint relieving roller at the opposite end of the print zone in each case; a castered roller following the print zone in the first embodiment and a gimbaled roller preceding the print zone in the second embodiment. As a result of the transit time of the print drops from the jetting module to the print media, variations in spacing of the printhead to the print media from one side of the printhead to the other, it is desirable to orient the printheads parallel to the print media. To maintain the uniformity of this spacing between the printhead and the print media, preferably the constraint relieving roller placed at one end of the print zone is not free to pivot in a manner that will alter the printhead to print media spacing. Therefore the gimbaled roller preceding the print zone in the second embodiment should not have a caster pivot as well. Similarly, the cantered roller following the print zone in the first embodiment should preferably not include a gimbal pivot. The use of nonrotating supports under the media in the print zone as shown in FIG. 10 and FIG. 11 can be used to eliminate this design restriction.

Figure 5:
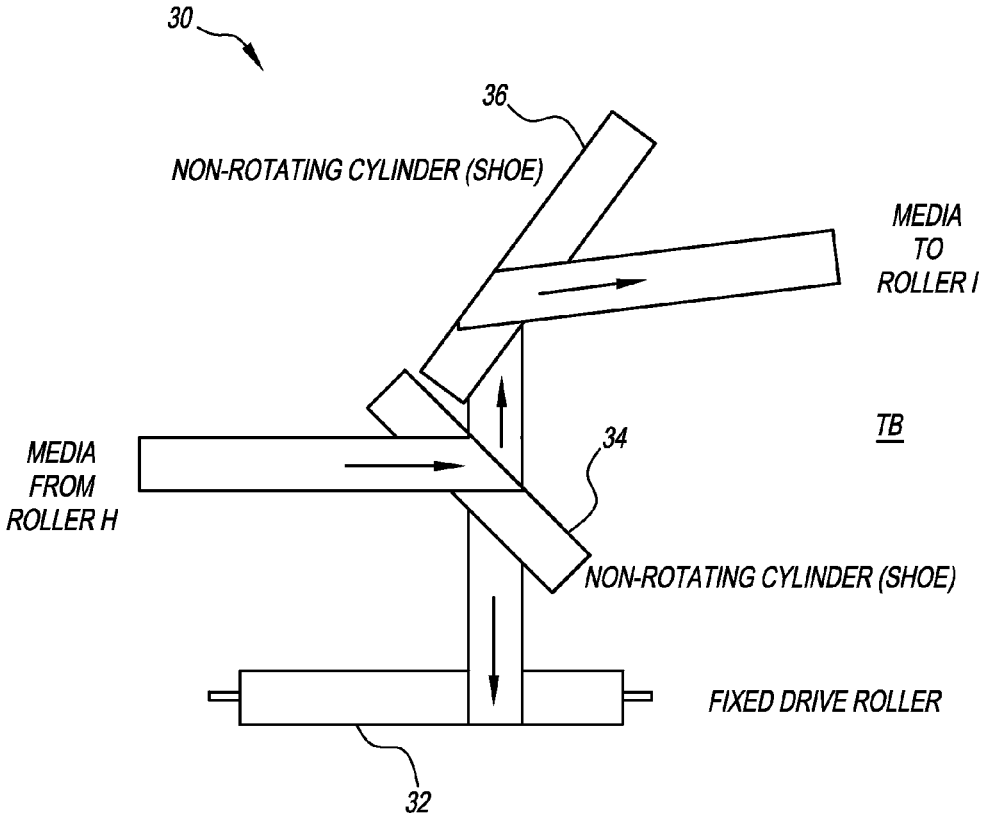
FIG. 5 is a top view showing the arrangement of rollers and surfaces within the turnover module in one example embodiment.
Figure 6:
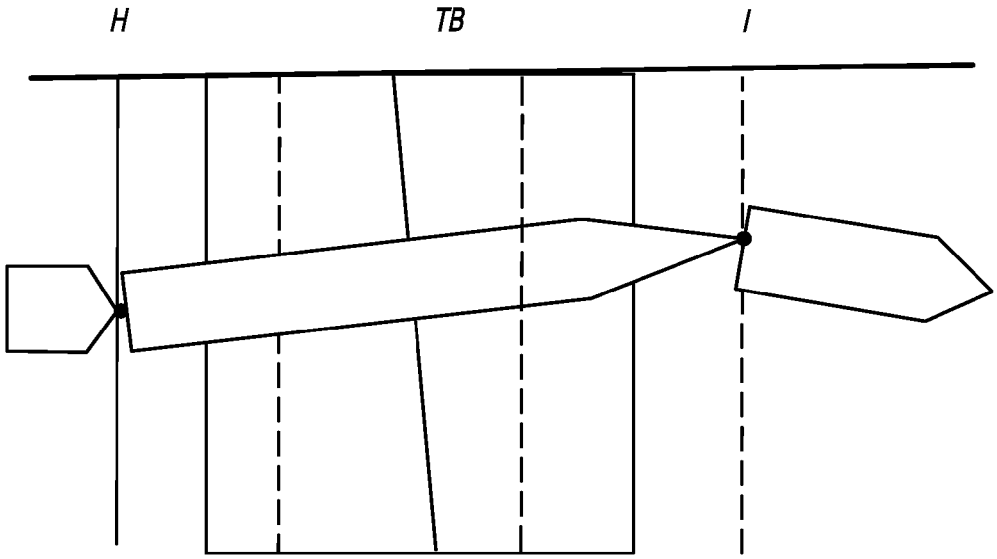
FIG. 6 is a web plane diagram for the turnover module of FIG. 5.

The top view of FIG. 5 and web plane diagram of FIG. 6 show the arrangement and constraint pattern, respectively, for turnover mechanism (TB) 30, shown as part of second module 40. Turnover mechanism TB can optionally be configured as a separate module, with its web media handling compatible with that of second module 40. The position of turnover mechanism TB is appropriately between print zones 54 for opposite sides of the media. Here, a fixed drive roller 32 of this device provides the single angular constraint. Lateral constraint is provided by the position of the moving web upstream of stationary turn-bar 34. Stationary turn-bars 34 and 36 are positioned at diagonals to the input and output paths and impart no constraint on the web as it slides over them. The use of a driven roller in the turnover mechanism, which can be driven independently of drive rollers B and N, allows the tension in the web to be separately maintained in the upstream and downstream of the turnover mechanism as will be discussed latter.

The system of the present invention is adaptable for a printing system of variable size and allows straightforward reconfiguration of a system without requiring precise adjustment and alignment of rollers and related hardware when modules are combined. The use of exact constraint mechanisms means that rollers can be mounted within the equipment frame or structure using a reasonable amount of care in mechanical placement and seating within the frame, but without the need to individually align and adjust each roller along the path, as would be necessary when using conventional paper guidance mechanisms. That is, roller alignment with respect to either the media path or another roller located upstream or downstream is not necessary.

Figure 7:
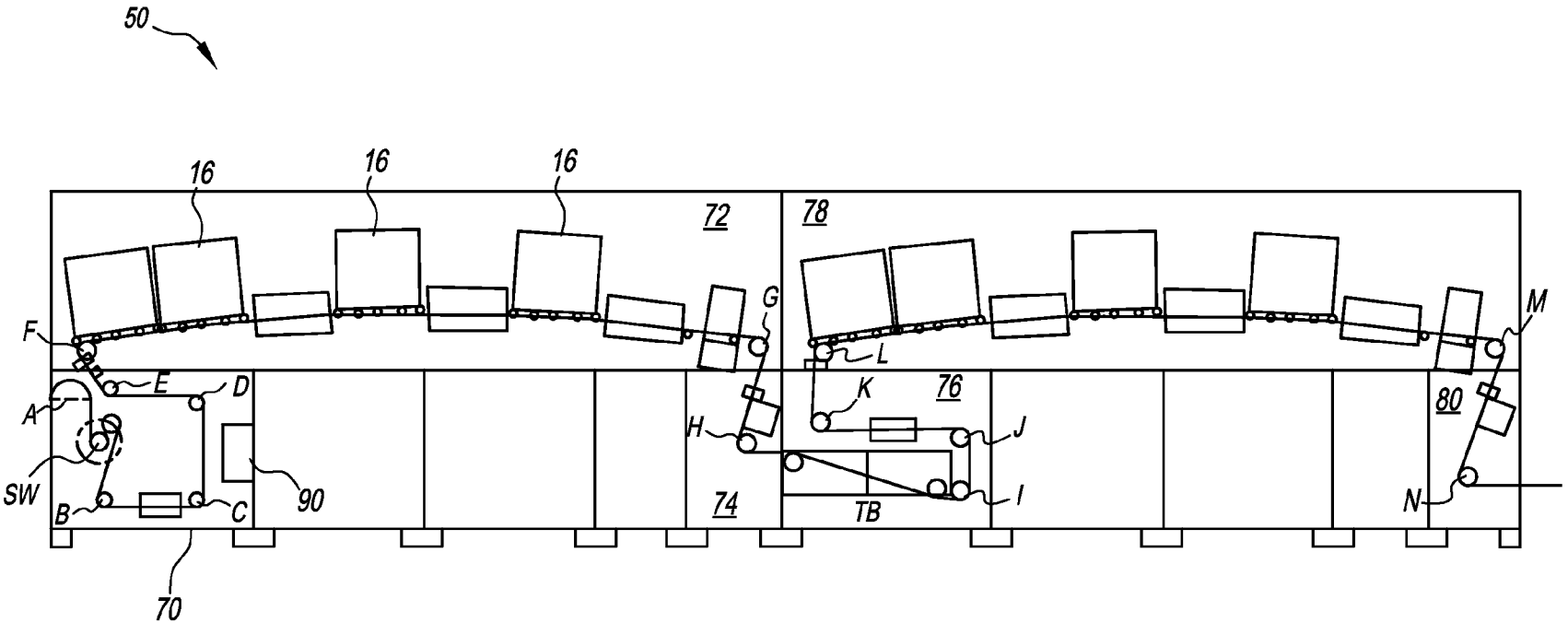
FIG. 7 is a schematic side view of a large-scale two-sided digital printing system according to another example embodiment of the present invention.
Figure 8:
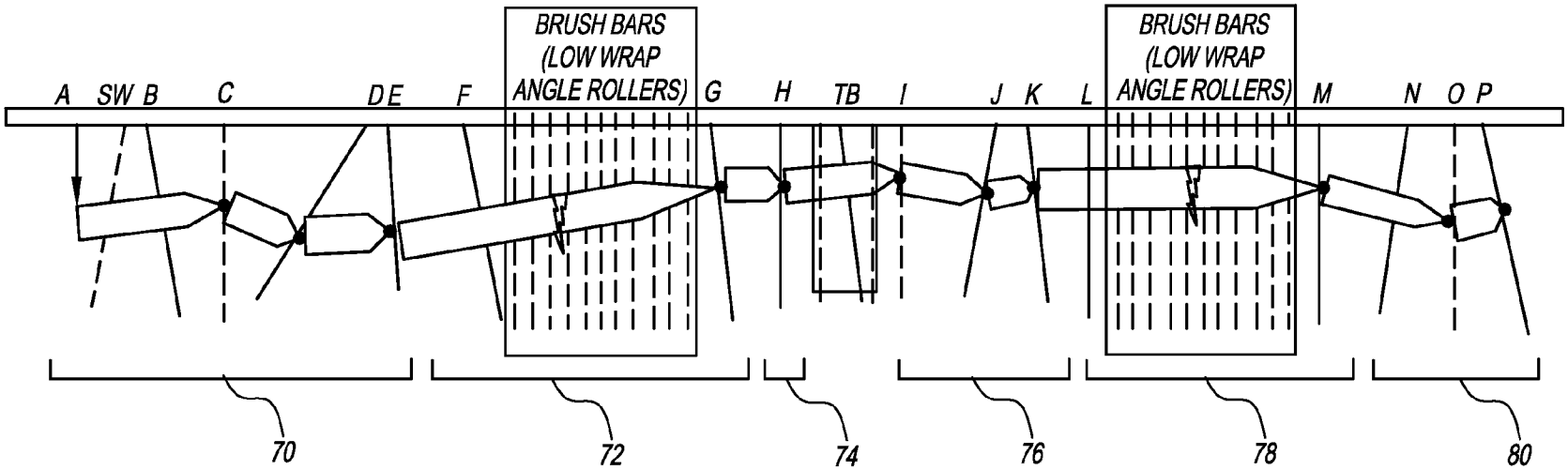
FIG. 8 is a web plane diagram for the web transport path of the digital printing system shown in FIG. 7.

A digital printing system 50 shown schematically in FIG. 7 and with its web plane diagram shown in FIG. 8 has a considerably longer print path than that shown in FIG. 3, but provides the same overall sequence of angular constraints, with the same overall series of gimbaled, castered, and fixed rollers. Table 3 lists the roller arrangement used with the system of FIG. 7 in one embodiment. Brush bars, shown between rollers F and G and between L and M in FIGS. 7 and 8, are non-rotating surfaces and thus apply no lateral or angular constraint forces.

TABLE 3

Roller Listing for FIG. 7

| Media Handling Component | Type of Component |
|---|---|
| A | Lateral constraint (edge guide) |
| SW - S-Wrap | Zero constraint (non-rotating support) |
| B | Angular constraint (in-feed drive roller) |
| C | Zero constraint (Castered and Gimbaled Roller) |
| D* | Angular constraint with hinge (Gimbaled Roller) |
| E | Angular constraint with hinge (Gimbaled Roller) |
| F | Angular constraint (Fixed Roller) |
| G | Angular constraint with hinge (Gimbaled Roller) |
| H | Angular constraint with hinge (Gimbaled Roller) |
| TB (TURNOVER) | See FIG. 5 |
| I | Zero constraint (Castered and Gimbaled Roller) |
| J* | Angular constraint with hinge (Gimbaled Roller) |
| K | Angular constraint with hinge (Gimbaled Roller) |
| L | Angular constraint (Fixed Roller) |

TABLE 3-continued

| Roller Listing for FIG. 7 | |
|---|---|
| Media Handling Component | Type of Component |
| M | Angular constraint with hinge (Gimbaled Roller) |
| N | Angular constraint (out-feed drive roller) |
| O | Zero constraint (Castered and Gimbaled Roller) |
| P | Angular constraint with hinge (Gimbaled Roller) |

Note:
Asterisk (*) indicates locations of load cells.

Load cells are provided in order to sense web tension at one or more points in the system. In the embodiments of FIGS. 3 (Table 1), 7 (Table 3), and 10 (Table 2), load cells are provided at gimbaled rollers D and J. Control logic for the respective digital printing system 50 monitors load cell signals at each location and, in response, makes any needed adjustment in motor torque in order to maintain the proper level of tension throughout the system. For the embodiments of FIGS. 3, 7, and 10, the pacing drive component of the printing apparatus is the turnover module TB. There are two tension-setting mechanisms, one preceding and one following turnover module TB. On the input side, load cell signals at roller D indicate tension of the web preceding turnover module TB; similarly, load cell signals at roller J indicate web tension on the output side, between turnover module TB and take-up roll 18. Control logic for the appropriate in- and out-feed driver rollers at B and N, respectively, can be provided by an external computer or processor, not shown in Figures of this application. Optionally, an on-board control logic processor 90, such as a dedicated microprocessor or other logic circuit, is provided for maintaining control of web tension within each tension-setting mechanism and for controlling other machine operation and operator interface functions. As described, the tension in a module preceding the turn bar and a module following the turnover module TB can be independently controlled relative to each other further enhancing the flexibility of the printing system. In this example embodiment, the drive motor is included in the turnover module TB. In other example embodiments, the drive motor need not be included in a turnover mechanism. Instead, the drive motor can be appropriately located along the web path so that tension within one module can be independently controlled relative to tension in another module.

The configurations of FIGS. 1, 3, and 10 were described as including two modules 20 and 40. In the FIG. 1 configuration, each module provided a complete printing apparatus. However, the "modular" concept need not be restricted to apply to complete printers. Instead, the configuration of FIG. 7 can be considered as formed of as many as seven modules, as follows:

(1) An entrance module 70 is the first module in sequence, following the media supply roll, as was shown earlier with reference to FIG. 1. Entrance module 70 provides the edge guide A that positions the media in the cross-track direction and provides the S-wrap SW or other appropriate web tensioning mechanism. In the embodiment of FIG. 7, entrance module 70 provides the in-feed drive roller B that cooperates with SW and other downstream drive rollers to maintain suitable tension along the web, as noted earlier. Rollers C, D, and E are also part of entrance module 70 in the FIG. 7 embodiment.

(2) A first printhead module 72 accepts the web media from entrance module 70, with the given edge constraint, and applies an angular constraint with fixed roller F. A series of stationary brush bars or, optionally, minimum-wrap rollers then transport the web along past a first series of printheads 16 with their supporting dryers and other components. Here, because of the considerable web length in the web segment beyond the angular constraint provided by roller F (that is, the distance between rollers F and G), that segment can exhibit flexibility in the cross track direction which is an additional degree of freedom that needs to be constrained. Eliminating the expected caster of roller G provides the additional constraint needed in that span.

(3) An end feed module 74 provides an angular constraint to the incoming media from printhead module 72 by means of gimbaled roller H.

(4) Turnover module TB accepts the incoming media from end feed module 74 and provides an angular constraint with its drive roller, as described previously.

(5) A forward feed module 76 provides a web span corresponding to each of its gimbaled rollers J and K. These rollers again provide angular constraint only; the lateral constraint for web spans in module 76 is obtained from the edge of the incoming media itself.

(6) A second printhead module 78 accepts the web media from forward feed module 76, with the given edge constraint, and applies an angular constraint with fixed roller L. A series of stationary brush bars or, optionally, minimum-wrap rollers then feed the web along past a second series of printheads 16 with their supporting dryers and other components. Here again, because of considerable web length in the web segment (that is, extending the distance between rollers L and M), that segment will exhibit flexibility in the cross track direction which is an additional degree of freedom that needs to be constrained, eliminating the expected caster of roller M provides the additional constraint needed in that span. overhang in the web span (that is, extending the distance between rollers L and M), exact constraint principles are difficult to apply successfully. Gimbaled roller M provides additional constraint over this long web span.

(7) An out feed module 80 provides an out-feed drive roller N that serves as angular constraint for the incoming web and cooperates with other drive rollers and sensors along the web media path that maintain the desired web speed and tension. Optional rollers O and P (not shown in FIG. 7) may also be provided for directing the printed web media to an external accumulator or take-up roll.

Annotation in FIG. 8 shows this modular breakdown.

Each module in this sequence provides a support structure and an input and an output interface for kinematic connection with upstream or downstream modules. With the exception of the first module in sequence, which provides the edge guide at A, each module utilizes one edge of the incoming web media as its "given" lateral constraint. The module then provides the needed angular constraint for the incoming media in order to provide the needed exact constraint or kinematic connection of the web media transport. It can be seen from this example that a number of modules can be linked together using the apparatus and methods of the present invention. For example, an additional module could alternately be added between any other of these modules in order to provide a useful function for the printing process.

Using the apparatus and methods of the present invention, module function can be adapted to the configuration of the complete printing system. In many cases, rollers and components can be interchangeable, including rollers at the interface between modules, moved from one module to another as best suits the printer configuration. Frames and other support structures for the different modules can use a standard design and dimensions or can be designed differently according to the contemplated application. This also helps to simplify upgrade situations.

Figure 9:
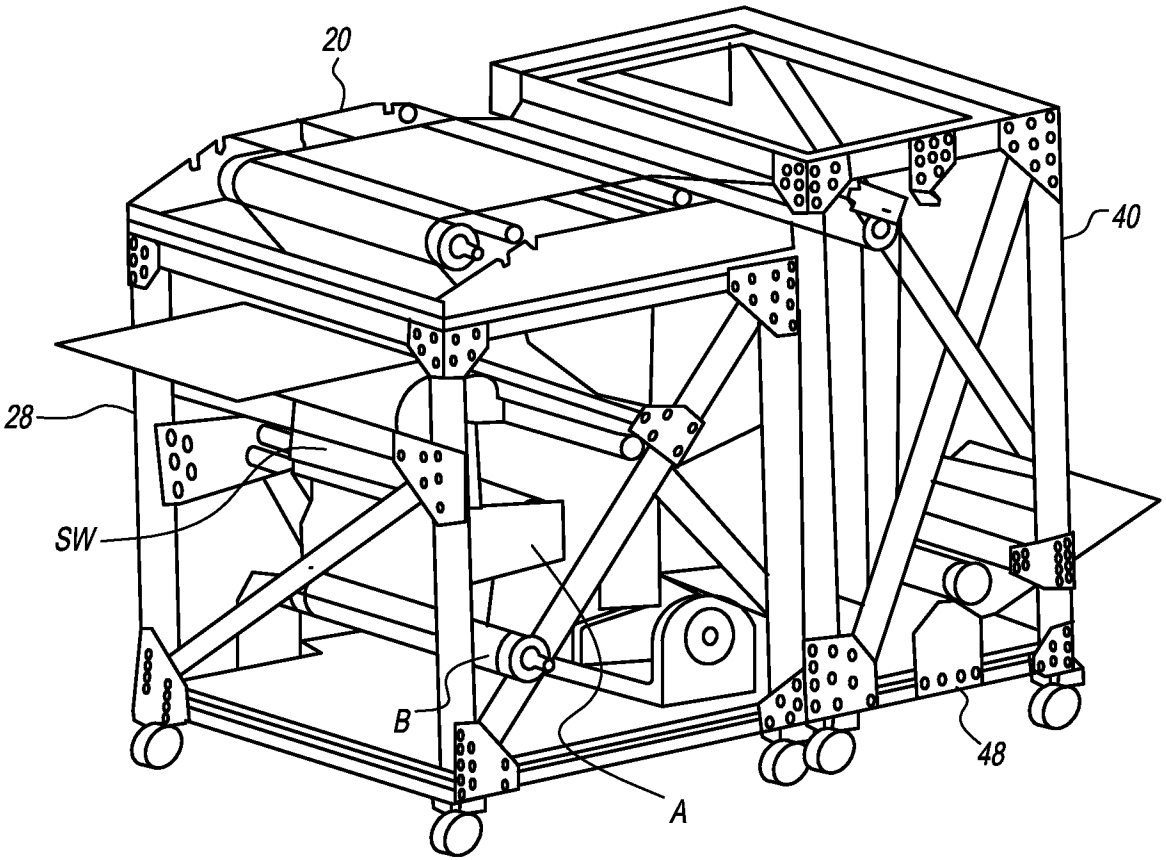
FIG. 9 is a perspective view of a printing apparatus according to another example embodiment of the present invention, with covers and printhead and support components removed for better visibility.

The perspective view of FIG. 9 shows two interconnected modules 20 and 40 in one embodiment. A support structure 28, shown without covers and without printhead and supporting dryer for visibility of internal components, provides a supporting frame for mounting components within module 20. Similarly, a support structure 48 provides a supporting frame for mounting components within module 40.

There are a number of ways to track web position in order to locate and position inkjet dots or other marking that is made on the media. A variety of encoding and sensing devices could be used for this purpose along with the necessary timing and synchronization logic, provided by control logic processor 90 or by some other dedicated internal or external processor or computer workstation. Such encoders or sensing devices are typically placed just upstream of the print zone containing the one or more printheads, and are preferably placed on a fixed roller so as to avoid interfering with self aligning characteristic of castered or gimbaled rollers.

In order to provide a digital printing system for non-contact printing onto a continuous web of print media at high transport speeds, the apparatus and method of the present invention apply a number of exact constraint principles to the problem of web handling, including the following:

(a) Employing, over each web span, a pairing of lateral and angular constraints, with the angular constraint downstream of the lateral constraint. Over each web span subsequent to the first web span in the system, the method uses the given lateral position of the web as the given edge-constraint.

(b) Use of zero-constraint castered rollers, non-rotating surfaces, or low wrap angle rollers where it is necessary to guide the media without constraint. This is the case, for example, where there is an overhang condition, where some length of the web within a web span extends past the angular constraint for that web span.

(c) Use of gimbaled rollers where necessary to provide an angular constraint, taking advantage of the capability of the web to twist without over-constraint. Use of gimbaled only rollers where necessary to provide an angular constraint in the web span immediately upstream while imparting no angular constraint in the web span immediately downstream of that roller.

An active steering mechanism could be used within a web span, such as where the web span length of an overhang exceeds its width, so that the web no longer has sufficient mechanical stiffness for exact constraint techniques. This can happen, for example, where there is considerable overhang along the web span, that is, length of the web extending beyond the angular constraint for the span. This is the case for modules 72 and 78 in the embodiment described with respect to FIG. 7. In such a case, a castered roller in the overhang section of the web may no longer behave as a zero constraint, since some amount of lateral force from the web is needed in order to align the castered roller mechanism to the angle of the web span. This under-constraint condition, due to length of the overhang along this lengthy web span, can be corrected by application of an additional constraint.

Kinematic connection between modules 20 and 40 follows the same basic principles that are used for exact constraint within each web span. That is, cross-track or edge alignment is taken from the preceding module. Any attempt to re-register the media edge as it enters the next module would cause an over-constraint condition. Rather than attempting to steer the continuously moving media through a rigid and potentially over-constrained transport system, the media transport components of the present invention self-align to the media, thereby allowing good registration at high transport speeds and reducing the likelihood of damage to the media or misregistration of applied ink or other colorant to the media.

Where multiple modules are used, as was described with reference to the embodiment shown in FIG. 7, it is important that the system have a master drive roller that is in control of web transport speed. Multiple drive rollers can be used and can help to provide proper tension in the web transport (x) direction, such as by applying suitable levels of torque, for example. In one embodiment, the turnover TB module drive roller acts as the master drive roller. The in-feed drive roller at B in module 20 adjusts its torque according to a load sensing mechanism or load cell that senses web tension between the drive and in-feed rollers. Similarly, out-feed drive roller N can be controlled in order to maintain a desired web tension within second module 40.

Figure 12:
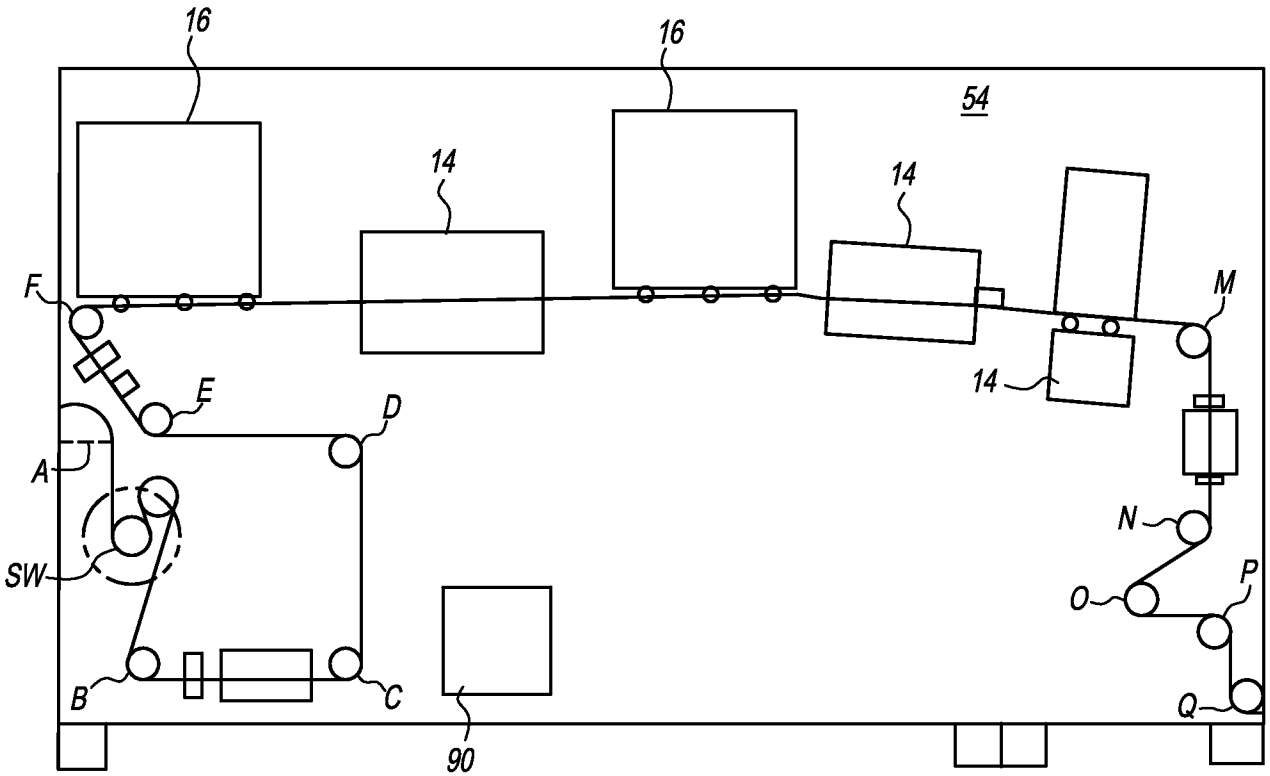
FIG. 12 is a schematic side view of a digital printing system according to another example embodiment of the present invention.
Figure 13:
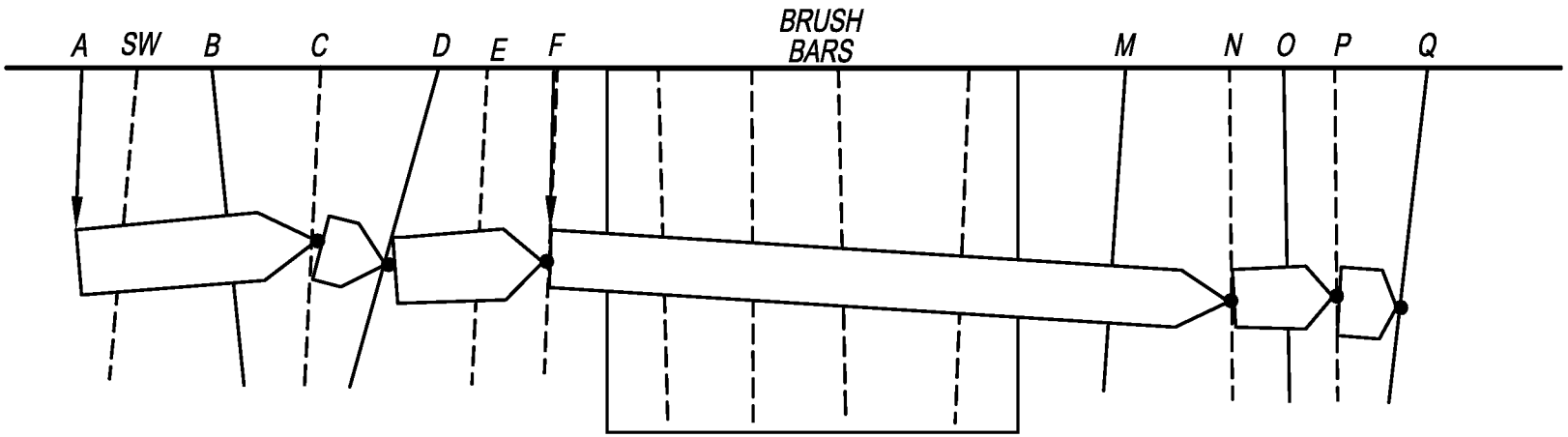
FIG. 13 is a web plane diagram for the web transport path of the digital printing system shown in FIG. 12.

FIG. 12 shows another embodiment of the present invention. The constraints provided by each roller are listed in table 4 and are illustrated in a web plane diagram in FIG. 13. In this embodiment, the web position in the span containing the printheads 16 and dryers 14 is defined by a lateral constraint in the form of an edge guide F located immediately before the print zone and an angular constraint, non-pivoting roller M, located immediately after the print zone. With the media under tension as it wraps around the shoe of the edge guide F, it is necessary to have the shoe free to pivot. This ensures that the media has uniform tension across its width in the print zone. In this embodiment the shoe is allowed to rotate about an axis at the center of the shoe and perpendicular to the plane of the web segment from F to M. This rotation orientation eliminates any variation in spacing between the media and printheads 16 as shoe F pivots. (When the media is not under tension as it passes over the edge guide, the edge guide shoe need not be free to pivot.) This embodiment also has an edge guide A and a non-pivoting drive roller B that establish an initial path for the media in the first span of the media entering the printing system. The combination of the castered and gimbaled rollers C and E and the gimbaled roller D eliminate an over-constraint condition that would have existed between the first media span and the span across the print zone. Edge guide A helps to ensure that the only minor shifting of the lateral position of the web is needed at edge guide F. This allows the bias force needed to shift the media to the edge stop to be kept to a minimum. (With the media under tension as it passes edge guide F, the required bias force to shift the media is greater than it would be if the media were not under tension.)

TABLE 4

Roller Listing for FIG. 12

| Media Handling Component | Type of Component |
|---|---|
| A | Lateral Constraint (Edge Guide) |
| SW - S-Wrap | Zero Constraint (Non-Rotating Support). Tensioning. |
| B | Angular Constraint (In-Feed Drive Roller) |
| C | Zero Constraint (Castered and Gimbaled Roller) |
| D* | Angular Constraint with Hinge (Gimbaled Roller) |
| E | Zero Constraint (Castered and Gimbaled Roller) |
| F | Lateral Constraint (Edge Guide) |
| Brush Bars | Zero Constraint (Non-Rotating Support) |
| M | Angular Constraint (Non-Pivoting Roller) |

TABLE 4-continued

| Roller Listing for FIG. 12 | |
|---|---|
| Media Handling Component | Type of Component |
| N | Zero Constraint (Castered and Gimbaled Roller) |
| O | Angular Constraint (Out-Feed Drive Roller) |
| P | Zero Constraint (Castered and Gimbaled Roller) |
| Q | Angular Constraint with Hinge (Gimbaled Roller) |

Note:
Asterisk (*) Indicates Locations Of Load Cells.

In this embodiment of FIG. 12, the printing system doesn't comprise multiple modules. All the media transport components are secured to a single support structure. Through the use of rollers that will align to the web, it is not necessary to precisely align the rollers to each other in this system. This greatly reduces the assembly costs for the system. As precise alignments are not required, the support structure to which the various rollers and web guides are mounted doesn't need to be as stiff as prior art frames. This allows the mass of the support structure to be greatly reduced which reduces shipping and setup costs.

As was shown in the web plane diagrams of FIGS. 4, 8, 11, and 13, edge guide A provides an initial edge constraint for the first in the series of web spans within printing system 10. Other edge guides are described at various other points along the web span, such as at F in FIG. 13, for example. In subsequent description and figures that follow, references to edge guide A are provided in order to provide a reference that aids understanding of the present invention in its various embodiments. However, it should be noted that the description that follows is applicable not only to edge guide A, but more generally to an edge guide that is disposed at any suitable point along the web transport path.

Among requirements for edge guide A for kinematic web handling are that it maintain center justification of the media web and that it provide center justification over a range of different media widths. The edge guide should provide the needed lateral constraint for the moving web, but without making a point contact with the web edges or surface or providing over-constraint. The edge guide must be able to introduce a measure of cross-track stiffness to the web media fed to it from slack loop 52 (FIG. 1).

Figure 14:
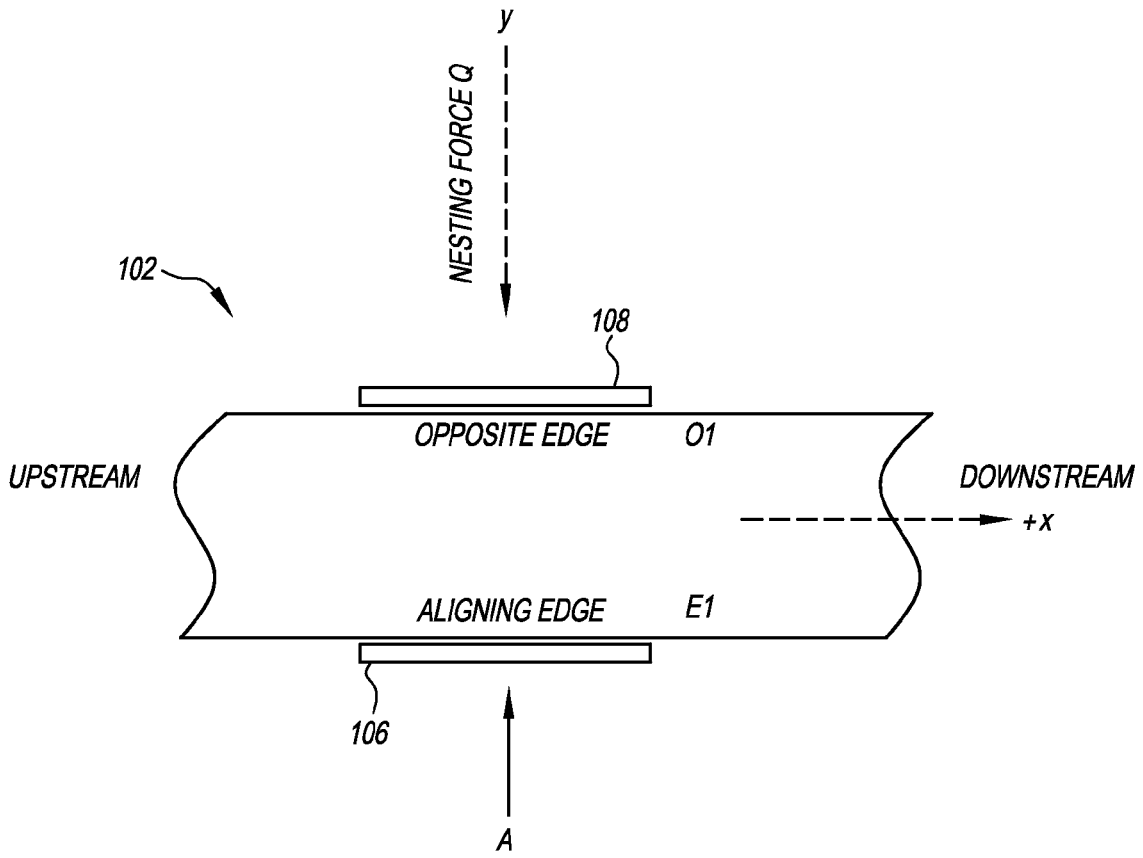
FIG. 14 is a schematic view showing terminology and relative coordinates used in subsequent description of the edge guide.

The schematic diagram of FIG. 14 shows, from a top view, terminology used in the description that follows. A continuous web substrate 102 moves from upstream to downstream, in the +x-coordinate direction, shown from left to right in the schematic diagram of FIG. 14. Web substrate 102 has an aligning edge E1 that provides the reference edge of the web and is aligned against a fixed media guide 106 of the edge guide as web substrate 102 moves. Fixed media guide 106 provides a lateral constraint. With respect to the exemplary embodiments and notation shown in FIGS. 4, 8, 11, and 13, this lateral constraint is provided at A, as indicated. A compliant media guide 108 of the edge guide imparts a nesting force Q against an opposite edge O1 that helps to maintain aligning edge E1 in position alongside fixed media guide 106. The nesting force Q is of selectable magnitude and is substantially directed in the cross-track or y-coordinate direction. In the example embodiments given subsequently, these terms, coordinates, and annotations are used to help to show how the various components of the edge guide of the present invention co-operate and interact.

Figure 15A:
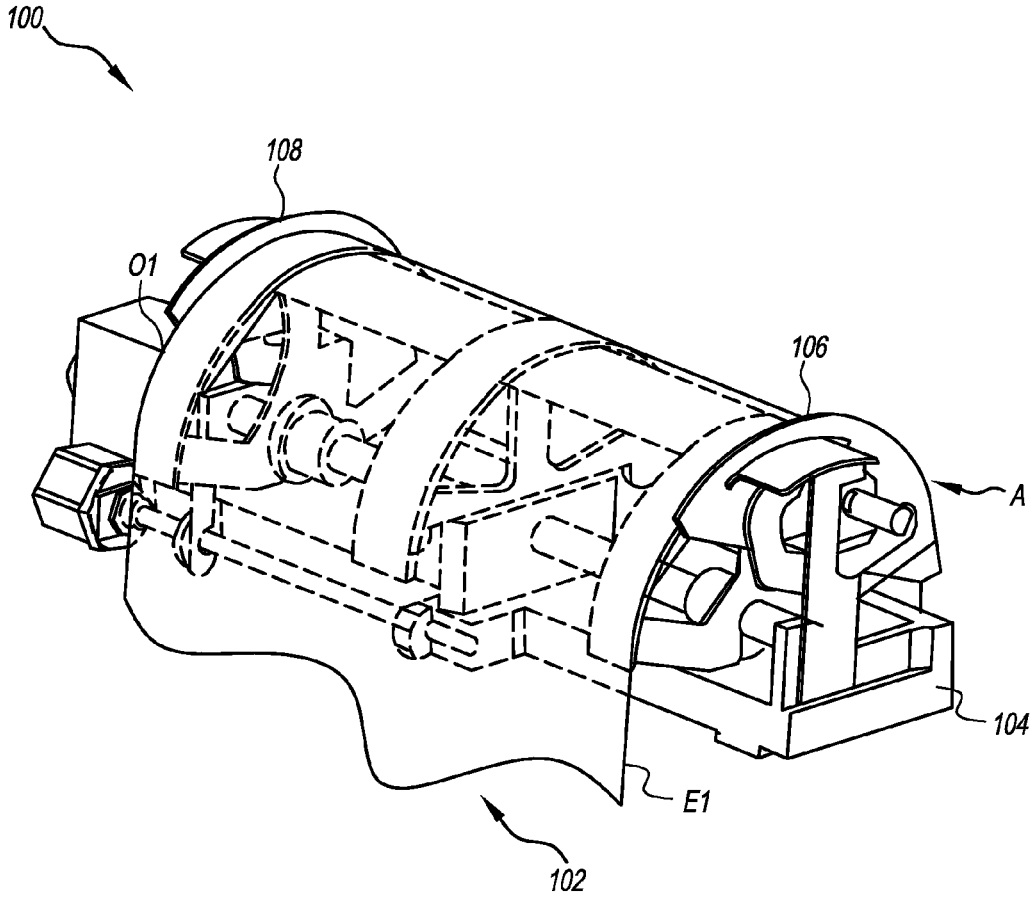
FIG. 15A is a perspective view of an edge guide showing the position of web media in one embodiment.
Figure 15B:
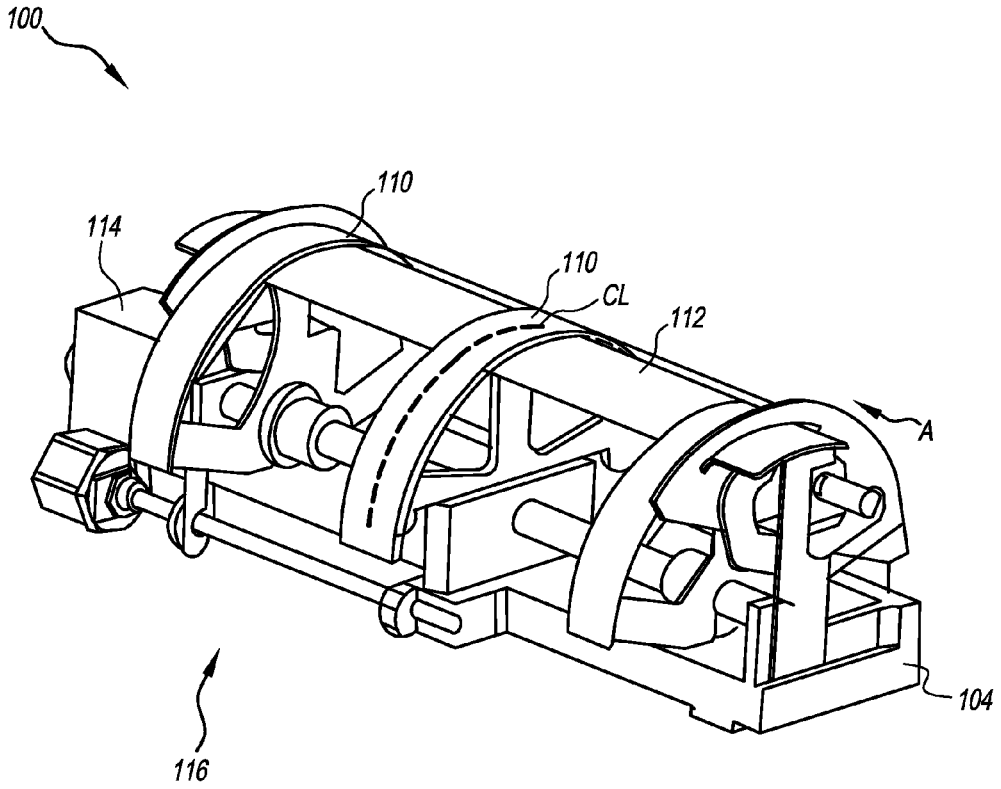
FIG. 15B is the perspective view of FIG. 15A without the web media.
Figure 15C:
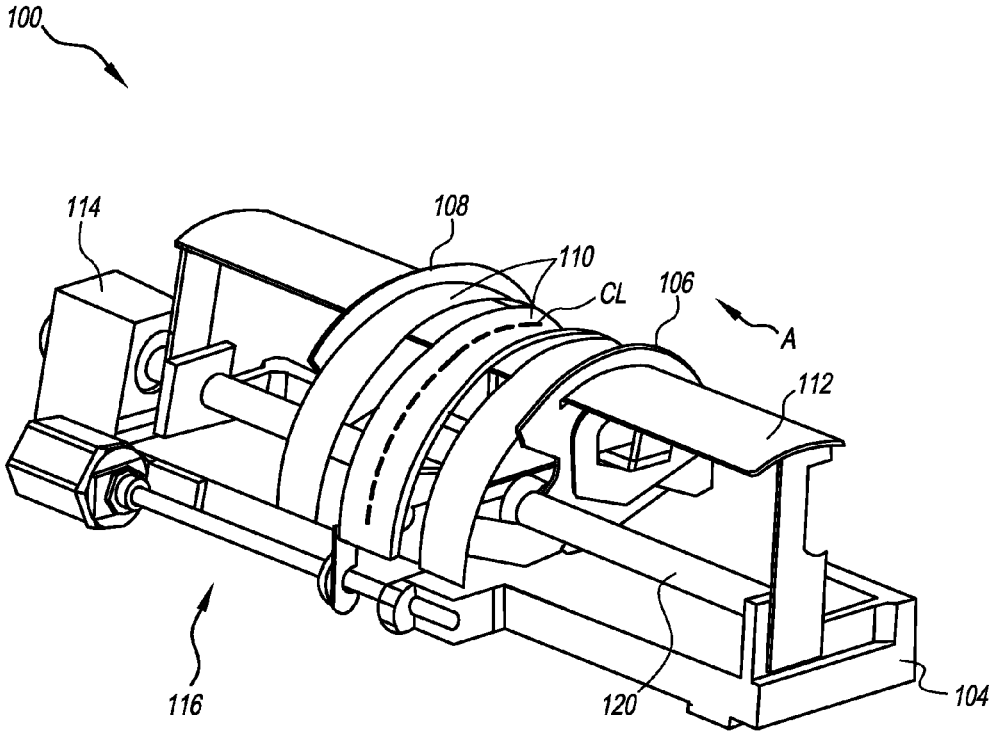
FIG. 15C shows the edge guide of FIGS. 15A and 15B adjusted for a narrower media width.
Figure 16A:
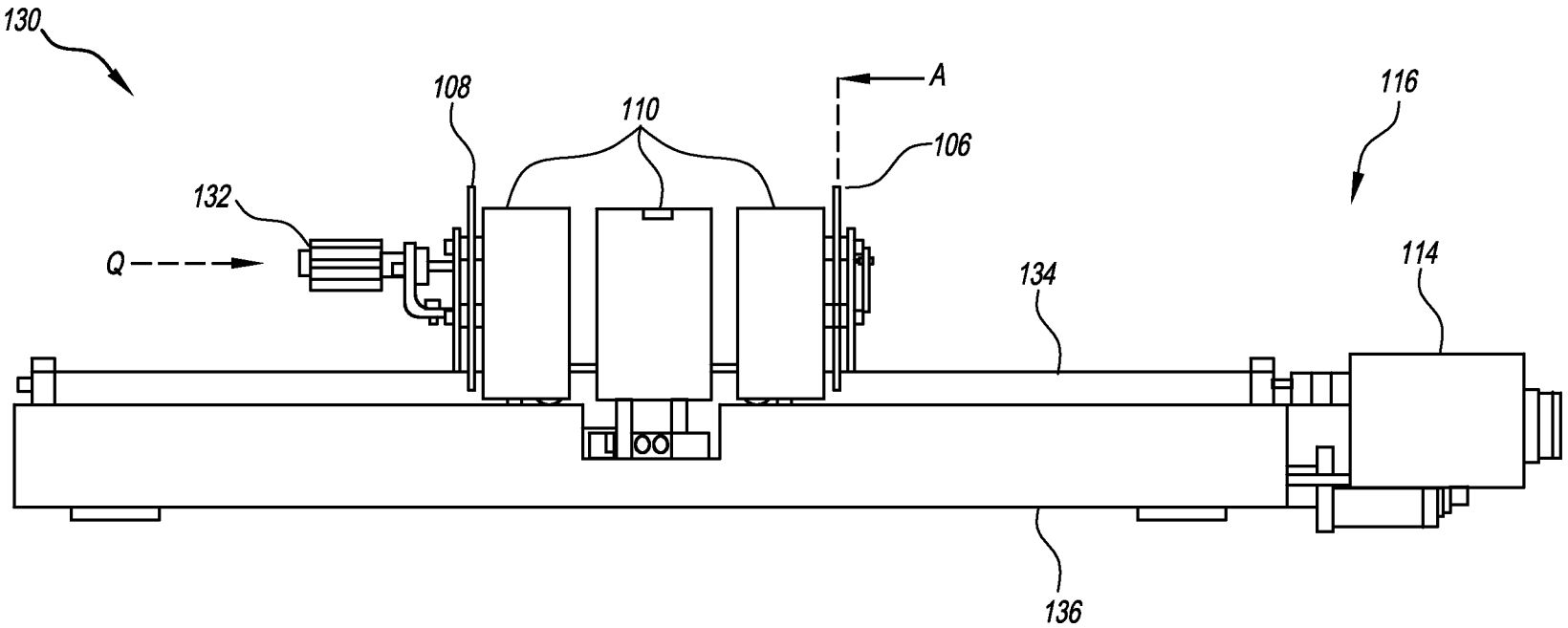
FIG. 16A is a side view of an edge guide according to one embodiment.
Figure 16B:
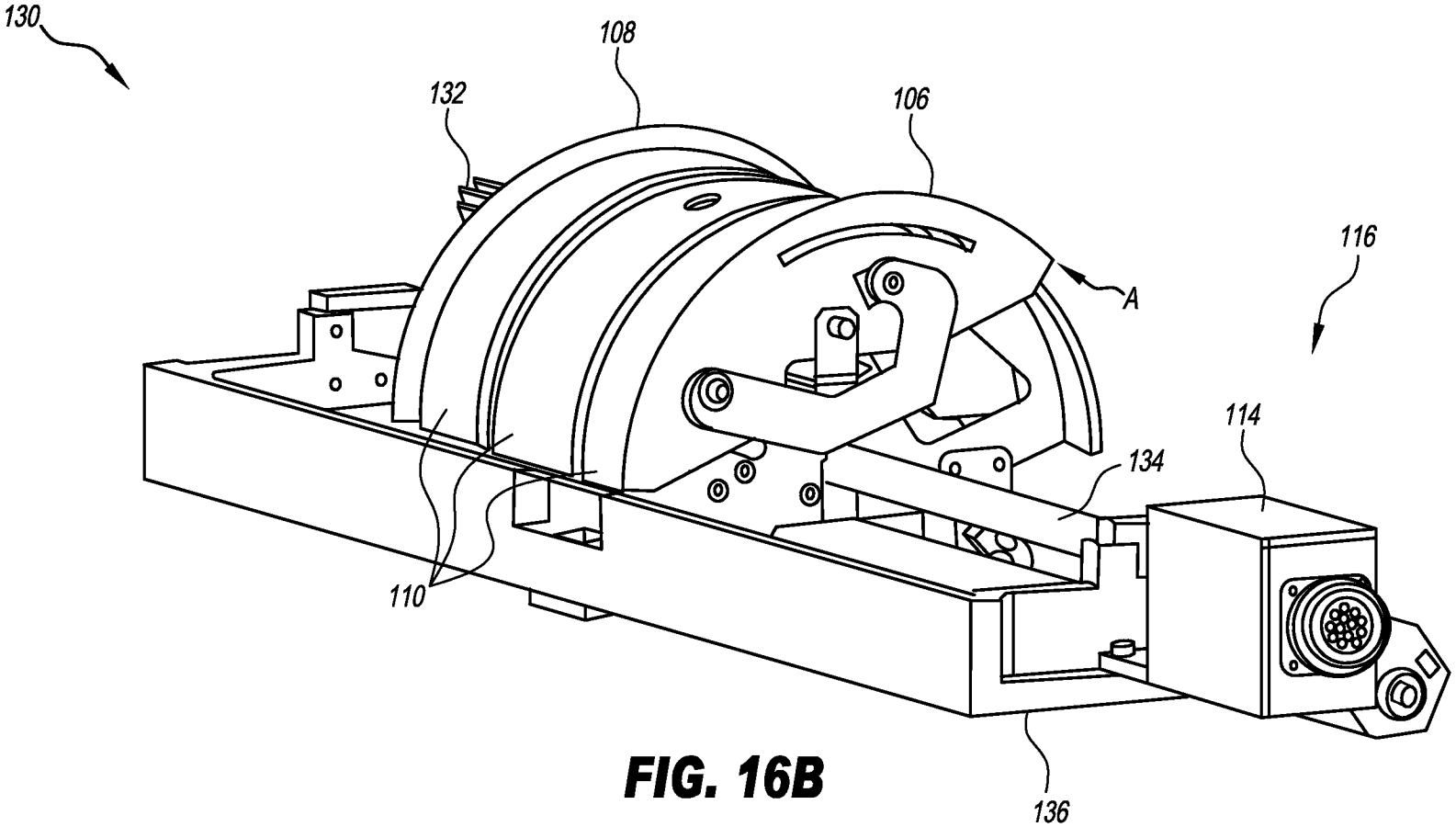
FIG. 16B is a perspective view of the edge guide of FIG. 16A, from the side of the fixed media edge.
Figure 16C:
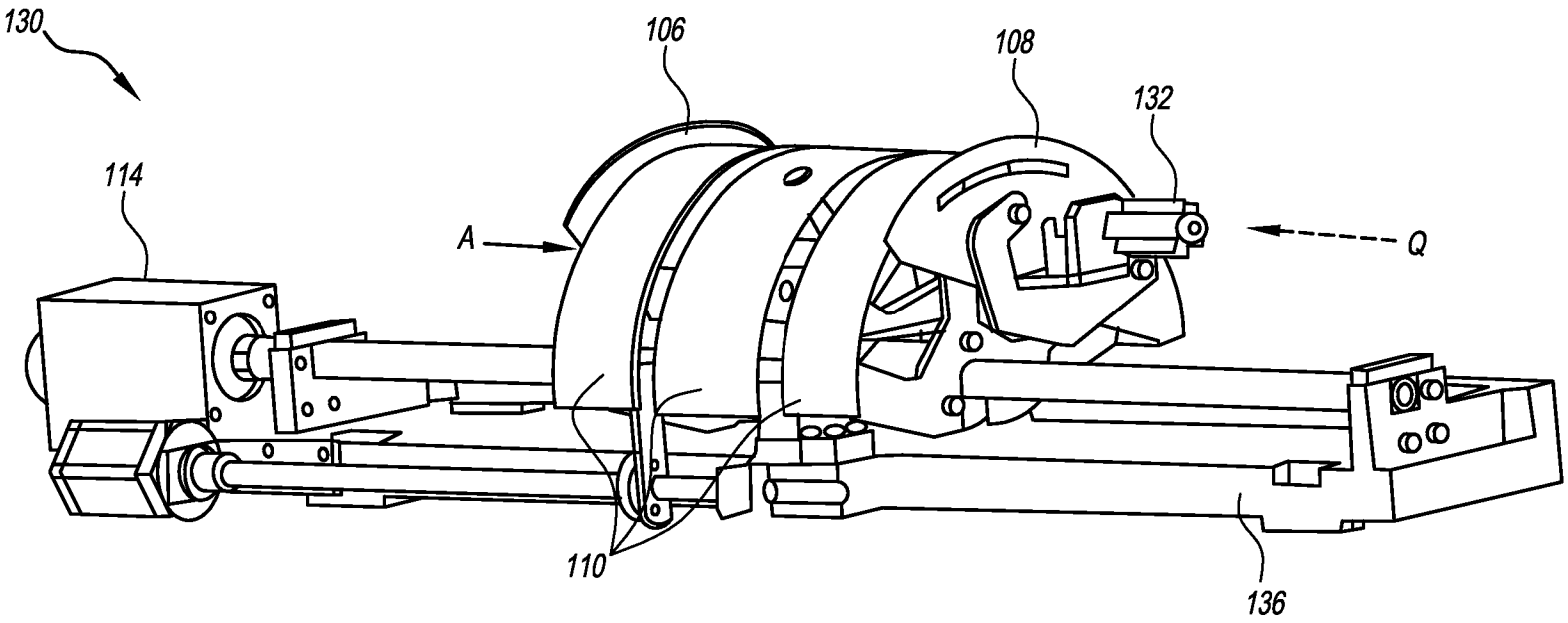
FIG. 16C is a perspective view of the edge guide of FIG. 16A, from the side of the compliant media edge.
Figure 16D:
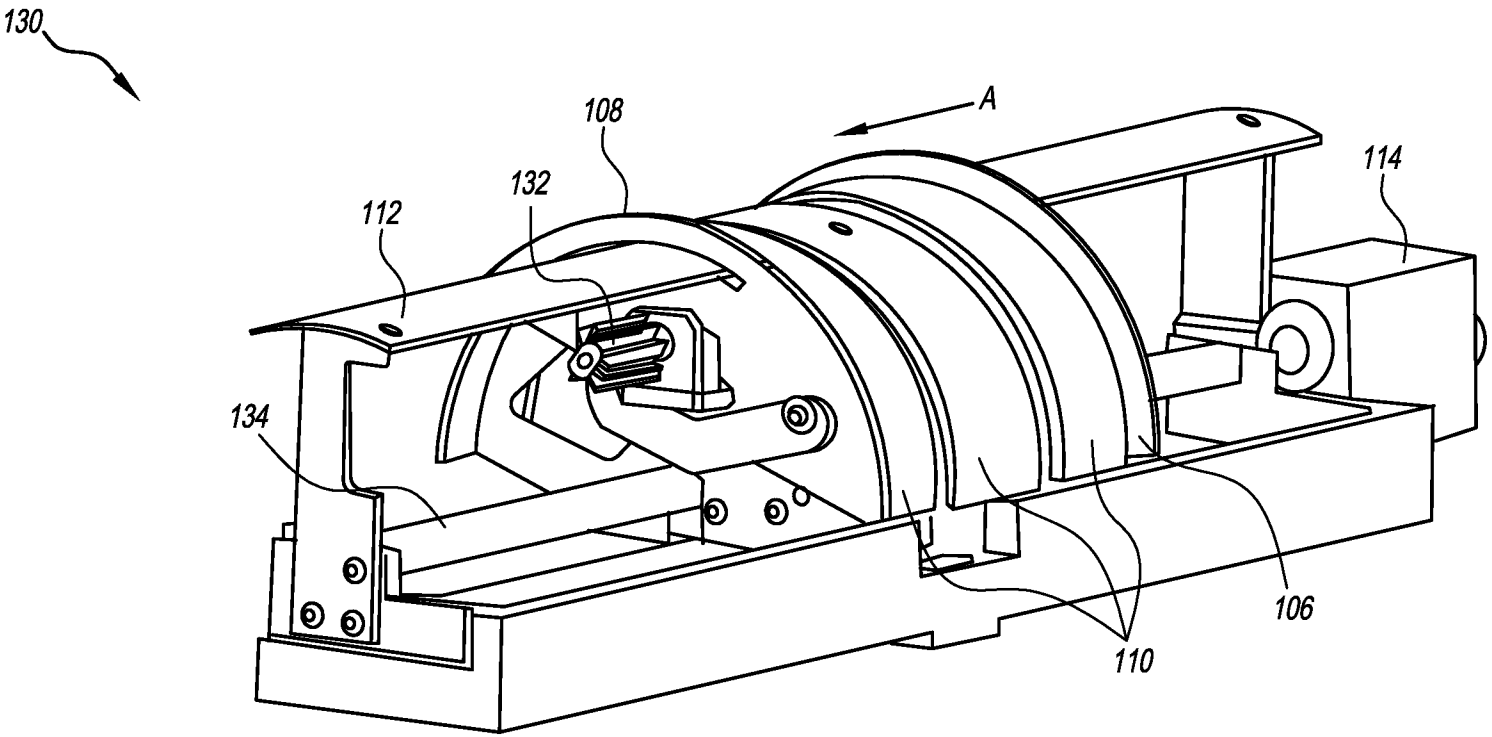
FIG. 16D is a perspective view of the edge guide of FIG. 16A, from the side of the compliant media edge, showing the position of a curved support structure that spans the length of the edge guide.

FIGS. 15A, 15B, and 15C show perspective views of an edge guide 100 for continuous web substrate 102 in one embodiment. For reference in these figures, the position of the corresponding lateral constraint shown at A in FIGS. 4, 8, 11, and 13 is shown for each view of edge guide 100 that follows. It should be noted that this reference to lateral constraint A is intended to be non-limiting, illustrating how edge guide 100 is used effectively in one embodiment, where edge guide 100 is disposed at the input to a kinematic web transport system. There can be, as described earlier, other positions along the web other than at media input where edge guide 100 is useful.

FIG. 15A shows continuous web substrate 102 as it is fed from an upstream slack loop 52 and into printing system 10, with underlying components traced in phantom form. FIG. 15B shows edge guide 100 with web substrate 102 removed in order to provide better visibility to underlying components, as adjusted for web substrate 102 at the width shown. FIG. 15C shows edge guide 100 adjusted for web media of narrower width.

Edge guide 100 has a mounting structure 104 that supports fixed media guide 106 for providing continuous contact alongside aligning edge E1 of the web media and compliant media guide 108 that is positioned along the opposite edge O1 of the web media and contactable against opposite edge O1. Between fixed and compliant guides 106 and 108 are a number of curved portions or segments, shown as ribs 110, that provide a curved, non-rotating, fixed surface for media travel. Compliant media guide 108 and curved ribs 110 are movable in the cross-track direction along a curved support beam 112, a second surface that lies behind ribs 110 and spans the distance between the contact edges of media guides 106 and 108 so that the spacing between ribs 110 and guides 106, 108 can be changed, allowing the use of different web media widths. An adjustment apparatus 116 enables the spacing between fixed and compliant guides 106 and 108 to be altered in order to accommodate different widths of web substrate 102. In the embodiment of FIGS. 15A-15C, a motor 114 is included as part of adjustment apparatus 116, enabling automated adjustment to media width in response to an operator command entry on a control console (described subsequently) or in response to some other signal. Alternately, a manual control can be provided to allow the operator to make the adjustment for web media width. With adjustment of the relative spacing between fixed and compliant guides 106 and 108, respectively, the center line CL between these edges remains substantially fixed. This relationship is shown in comparing FIGS. 15B and 15C. With this segmented arrangement, the center portion remains fixed and arranged along center line CL regardless of media width; the outer or end portions move toward or away from the center portion and center line CL in order to vary the spacing distance between media guides 106 and 108.

To provide a fixed surface over which the print media can travel, three ribs 110 are provided in the embodiment of FIGS. 15A-15C. The center rib 110 is stationary; outer ribs 110 are coupled to guides 106 and 108, but could also be separate from these guides. FIG. 15C shows edge guide 100 adjusted for a very narrow width medium. A lead-screw translation mechanism 120 enables automated adjustment of rib 110 and guide 106, 108 spacing.

Referring again to FIG. 15A, edge guide 100 shapes web substrate 102, initially slack and without significant cross-track stiffness, into a curved cylindrical form to increase its beam stiffness in the cross track direction. This helps to prevent the moving web media from deforming into the gaps between ribs 110. As is seen from FIGS. 15A-15C, the radius of curvature provided by edge guide 100 components is perpendicular to the direction of print media travel.

It is advantageous for guides 106 and 108 that contact the edges of the print media to be formed and treated in some way to provide a low coefficient of friction, that is, a coefficient of friction that is preferably in a range of 0.1 to no more than about 0.2, in order to minimize abrasion to the web substrate. The surfaces of one or both edge guides 106 and 108 are hardened and polished in one embodiment. A polytetrafluoroethylene (PTFE or Teflon) impregnated nickel coating is used for media guides 106 and 108 in one embodiment for reducing the coefficient of friction. In addition, a high abrasion resistance, exhibiting a Taber Wear index value of less than about 18, is advantageous for the media guide surface. The combination of low coefficient of friction and high abrasion resistance helps to extend the useful life of the device and reduce material or debris build-up.

For lateral constraint (at A in FIGS. 4, 8, 11, and 13), continuous contact of one edge of the moving web media alongside fixed media guide 106 is required. Embodiments of the present invention take advantage of the added crosstrack stiffness that is provided from edge guide 100, which allows a nesting force Q to be applied in the crosstrack direction without damaging or over-constraining the web. In operation, compliant media guide 108 includes an urging mechanism that applies the nesting force against its nearby edge of the web media, thereby causing the opposite edge O1 of the web media to move toward and into contact alongside fixed media guide 106.

Nesting force Q can be applied in a number of ways. In one embodiment, a constant magnitude nesting force is applied, and the magnitude can be adjusted or selected, such as to adapt to different media types or thicknesses. To achieve this in one embodiment, a spring is used to provide the needed nesting force for urging the media against fixed media guide 106. The spring tension can be adjusted to provide a greater or lesser amount of constant magnitude force, using either an automatic or manual adjustment by the operator. Similarly, other embodiments use other mechanisms that can adjust an amount of applied force of constant magnitude to different levels as needed. In one alternate embodiment, for example, compressed air or other fluid under pressure, such as a hydraulic fluid, is employed in order to provide a gentle, continuous nesting force that can be varied in magnitude as needed.

Nesting force Q, primarily directed in the cross-track direction, can be set to a selected, fixed level at the beginning of a print job, based on an operator adjustment or command, as described subsequently. Alternately, the magnitude of nesting force Q can be dynamically adjustable over a range, so that the amount of force varies with differences in sensed contact, pressure, position, or other measurable parameters or characteristics of the print media. Dynamically variable nesting force Q would be achieved using a control loop that measures a suitable operational parameter and makes necessary adjustments accordingly, as described in more detail subsequently.

FIGS. 16A through 16D show an alternate embodiment of an edge guide 130 and provide additional details on how compliant media guide 108 operates. For reference in these figures, the position of the corresponding lateral constraint shown at A in FIGS. 4, 8, 11, and 13 is also shown for each view of edge guide 130. Similar to the embodiment shown earlier in FIGS. 15A-15C, edge guide 130 has a mounting structure 136 that supports fixed media guide 106 for providing continuous contact along one edge of the web media, aligning edge E1, and compliant media guide 108 that is positioned along opposite edge O1 of the web media and contactable against this opposite edge. Between fixed and compliant guides 106 and 108 are a number of curved portions or segments, shown as ribs 110, that provide a curved cylindrical surface for media travel. Compliant media guide 108 and curved ribs 110 are movable in the cross-track direction along curved support beam 112 (not shown in FIG. 16A for better visibility of other parts of edge guide 130; but shown in FIG. 16C). Adjustment apparatus 116 enables the spacing between fixed and compliant guides 106 and 108 to be altered in order to accommodate different widths of web substrate 102. Motor 114 and a leadscrew 134 are also part of adjustment apparatus 116 in the embodiment shown, enabling automated adjustment to media width in response to an operator command entry on a control console (not shown) or other signal. Alternately, a manual control, such as an adjustment knob or other manual device, can be provided to allow operator adjustment for web media width.

In the embodiment of FIGS. 16A through 16D, the nesting force Q for moving web media is provided by an urging mechanism 132, a low-friction air cylinder. This air cylinder configuration acts as a type of flat spring, applying the continuous nesting force Q against the opposite edge O1 of the web. In one embodiment, the applied pressure is dynamically controllable, thereby allowing a variable force to be applied as needed. Optionally, a constant magnitude nesting force can be selected at the beginning of a print run and the constant magnitude maintained.

Pivotal Mounting

Figure 17A:
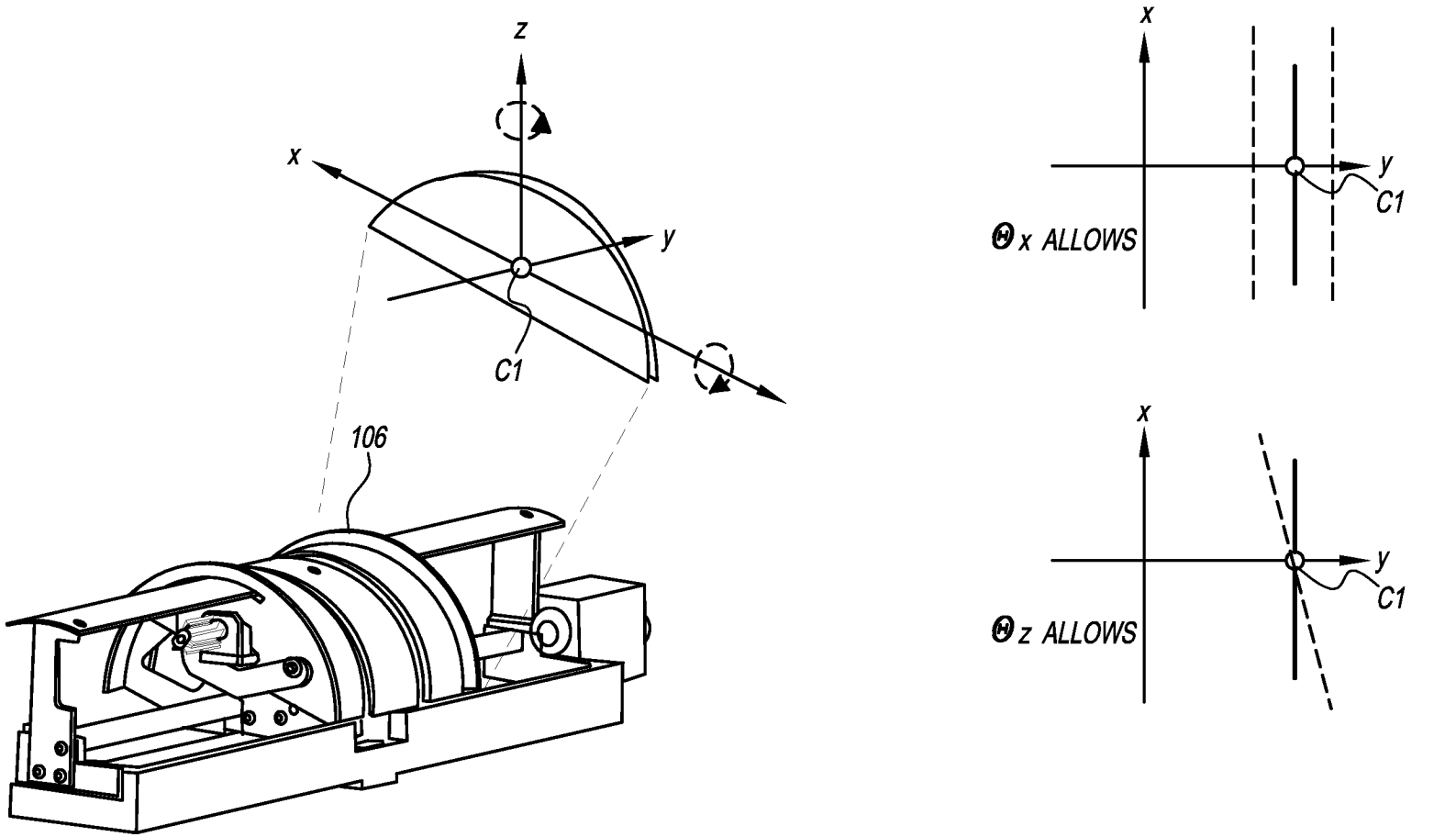
FIG. 17A is a perspective view with top view representations showing pivoting action of the fixed media edge.

Although one or both of fixed and compliant media guides 106 and 108 could be implemented to operate as fixed flanges, without any pivotal motion, there are advantages in allowing specific rotational degrees of freedom (DOF) for each of these elements. Referring to FIG. 17A, there is shown, in schematic form, the two rotational degrees of freedom allowed for fixed media guide 106 in one embodiment. Coordinate xyz axes are shown. Here, the mechanical arrangement of fixed media guide 106 allows θx and θz rotation, relative to a pivot point at centroid C1. Translation in any of the x, y, and z directions is constrained once adjustment for media width is made; rotation about the y axis is also constrained. The graphs along the right side of FIG. 17A show what translational or rotational movement is allowed given these DOFs, relative to the fixed y translation constraint (bold vertical line) and centroid C1. As is shown here, the θx rotation allows media guide 106 to contact aligning edge E along its full arc of travel in the edge guide. The θz rotation allows the aligning edge E1 to momentarily vary its angular orientation slightly over a range, again with reference to the position of centroid C1. Centroid C1, with its position determined by placement and shape characteristics of media guide 106, by aligning edge E1 as it travels against media guide 106, and supporting components, lies substantially at the intersection of the coordinate xyz axes relative to the permitted rotational DOFs. Centroid C1 corresponds to the centroid of curved aligning edge E1. This can be considered the centroid of the arc of contact over which the aligning edge E1 of the media travels alongside fixed media guide 106.

Figure 17B:
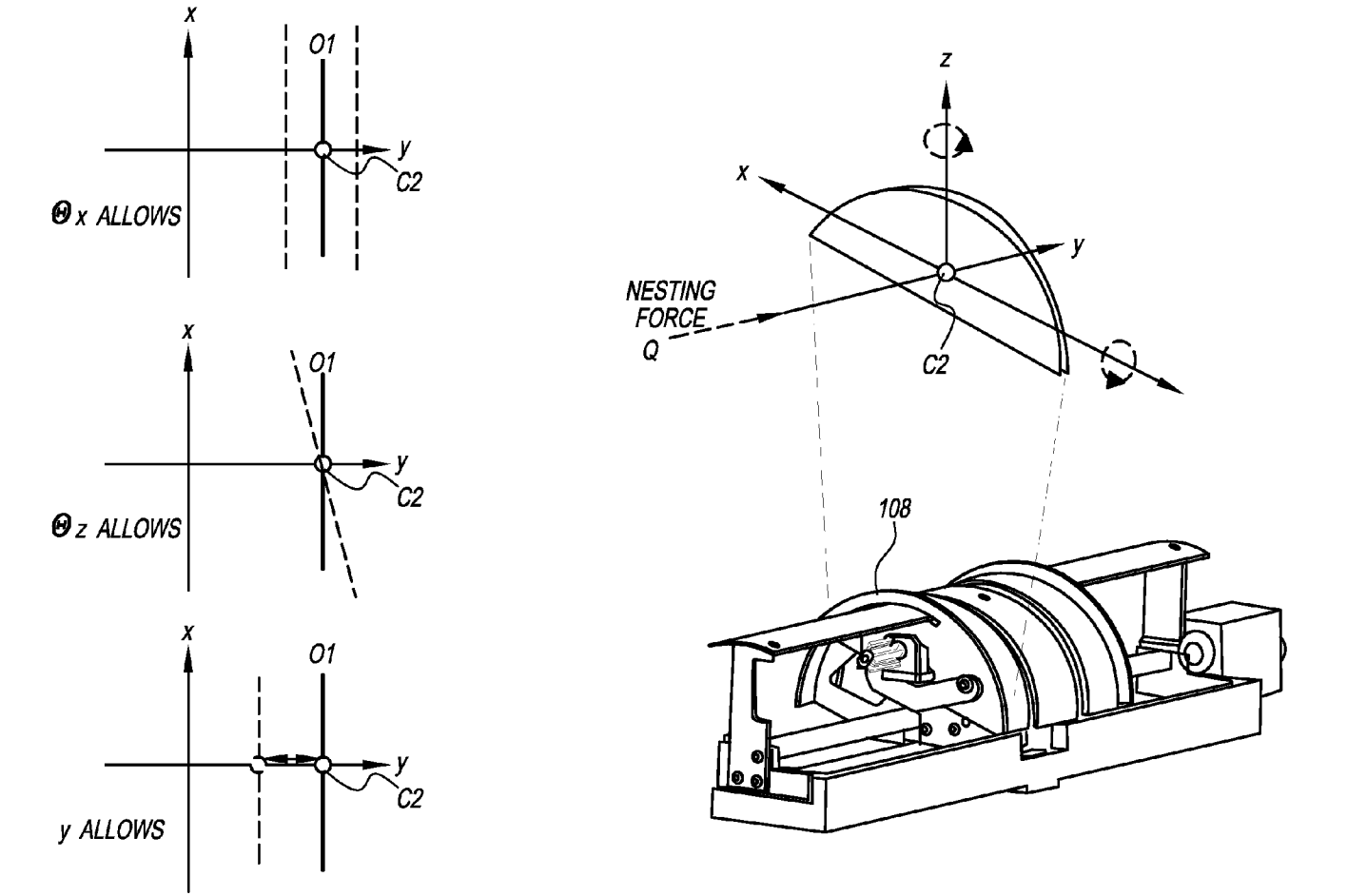
FIG. 17B is a perspective view with top view representations showing pivoting action of the compliant media edge.

The schematic diagram of FIG. 17B shows the pattern of constraints that are applied to compliant media guide 108 in one embodiment.

Here, the mechanical arrangement allows θx and θz rotation, relative to a pivot point at centroid C2 for compliant media guide 108. Translation in the y direction is permitted, according to the nesting force that must be applied. Movement along x and z directions is constrained The graphs along the left side of FIG. 17B show what movement is allowed given these DOFs, relative to the opposite edge O1 of the moving web substrate (vertical line) and centroid C2. As is shown here, the θx rotation allows media guide 108 to contact the opposite edge O1 of the web media along its full arc of travel. The θz rotation allows the opposite edge O1 to momentarily vary its angular orientation slightly over a range, again with reference to the position of centroid C2. Centroid C2, with its position determined by placement and shape characteristics of compliant media guide 108 and by opposite edge O1 as it travels against the surface of compliant media guide 108, lies substantially at the intersection of the coordinate xyz axes relative to the permitted rotational DOFs and corresponds to the centroid of the arc of contact over which the opposite edge O1 of the media travels alongside compliant media guide 108. The nesting force Q is preferably applied at the position of centroid C2.

Control Loop

Figure 18:
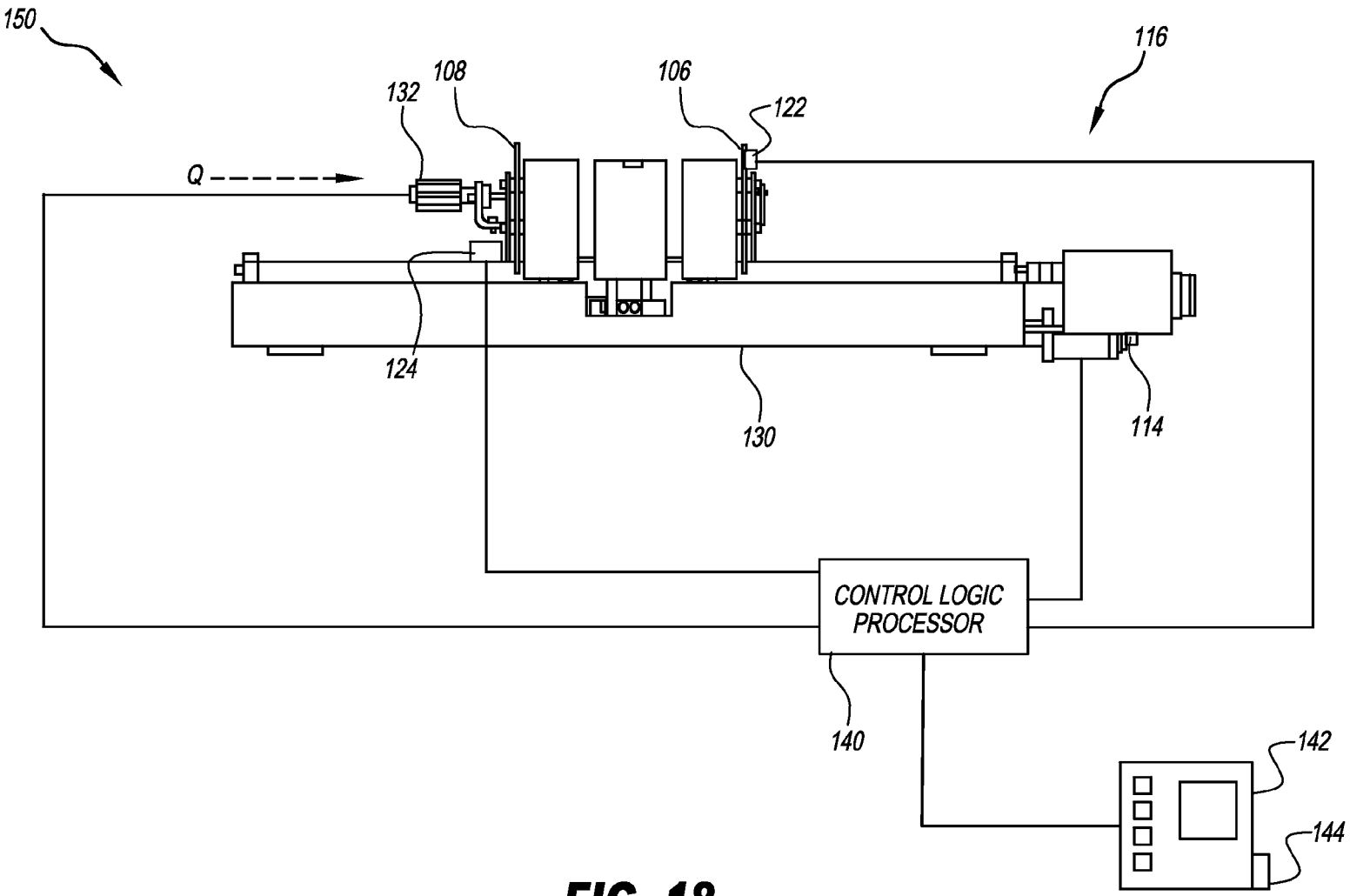
FIG. 18 is a schematic view showing a control loop for the edge guide in one embodiment.

The schematic diagram of FIG. 18 shows a control loop 150 that helps to automate the adjustment and operation of edge guide 130 in one embodiment. Controlling logic functions are provided according to programmed instructions stored and executed by a control logic processor 140. These may include operator instructions entered on a control panel 142, for example. For setting media width according to an operator entry on control panel 142, control logic processor 140 controls motor 114 of adjustment apparatus 116 and reads feedback signals from a displacement sensor 122. Sensor 122 provides a signal that indicates the distance between fixed and compliant media guides 106 and 108. Alternately, a stepper motor or other calibrated positioning apparatus could be used for setting the media width.

Control logic processor 140 can be any of a number of types of computer, microprocessor, or dedicated logic processing device that executes pre-programmed stored instructions for control of control loop 150, according to input signals received. In one embodiment, control logic processor 140 also controls web tension, motor speeds, and other printer variables, as described earlier with reference to control logic processor 90.

Still referring to FIG. 18, a second sensor 124, shown positioned near compliant media guide 108, provides a signal that is indicative of how well alignment edge E1 is aligned alongside and contacting the edge of fixed media guide 106. Sensor 124 can be a force sensor, pressure sensor, displacement sensor, or some other suitable sensor type for indicating edge alignment. Sensor 124 can be placed at or near either fixed media guide 106 or compliant media guide 108. Sensor 124 can be disposed to indicate whether or not there is a bias to guide positioning or orientation. Signals from sensor 124 can be used to control the setting of air pressure or other selectable magnitude force at urging mechanism 132, for example.

It should be noted that either or both of the adjustment functions that are automatically controlled in control loop 150 could be manually controlled. For example, a control knob or other manual control element could be used in place of motor 114 for manual adjustment by the operator to suit media width. Optionally, a motor is provided for making adjustments for media width under the control of an operator. The amount of nesting force provided by urging mechanism 132 could also be adjusted manually in one embodiment, so that an operator adjusts or fine-tunes the nesting force provided for maintaining edge alignment against fixed media guide 106. In one embodiment, control loop 150 is used to dynamically adjust the magnitude of nesting force Q that is applied for nesting the alignment edge E of the web media against the surface of media guide 106, varying the magnitude of nesting force Q as needed during a print run. Nesting force Q can be adjusted based on signals from one or more of sensors 122 and 124, for example.

Settings of control panel 142 can provide various types of information that are then used in order to make the automated settings for media width and for nesting force applied, which may be of constant magnitude. In one embodiment, for example, operator input includes specifying the type of media, which automatically sets media width and nesting force Q variables at edge guide 130. Manufacturer data can include information on roll dimensions, substrate stiffness and thickness, weight, moisture content, material composition, whether coated or uncoated, surface finish or gloss, perforation, and other useful information for controlling adjustable components of edge guide 130. Optionally, the operator enters one or more characteristics of the print media, such as media stiffness, gloss, thickness, weight, or other parameter that can be used to determine how much nesting force should be applied or to set a range for nesting force values. The ability to enter different parameters allows a printing apparatus to adapt to different weights of the same print media, for example. The amount of nesting force that is applied may also be a factor of media transport speed.

An optional sensor 144, such as a bar code scanner or other optical sensing device, an ultrasonic or electrical sensor, or an RF ID transponder in communication with control panel 142 can alternately be used to sense media type or characteristics from the roll of web media or from the media packaging. This enables fully automated setup of media transport system variables for a printing apparatus, without the need for further operator intervention.

In one embodiment, sensors and actuators are provided to fully automate the media loading operation, including setting the appropriate distance between media guides 106 and 108 for the media width and sensing media characteristics that determine the nesting force setting. The operator merely feeds the new roll of web media, center-justified, into edge guide 130, then allows sensors and actuators associated with edge guide 130 to position media guides 106 and 108 and apply the nesting force of the needed magnitude.

It can be seen that the method of the present invention can be applied for handling continuous web media transport within and between one, two, three, or more modules applying exact constraint techniques. This flexibility allows a web transport arrangement that provides good registration and repeatable performance at high speeds commensurate with the requirements of high-speed color inkjet printing. As has been shown, multiple modules can be integrated to form a printing system, without the requirement for painstaking alignment of rollers or other media handling components at the interface between two modules.

It has been found that web transport systems as described above maintain effective control of the print media in the context of a digital print system where the selected portions of the print media are moistened in the printing process. This is true even when the print media is prone to expanding in length and width and to becoming less stiff when it is moistened, such as for cellulose based print media moistened by a water based ink. This enables the individual color planes of a multicolored document to be printed with good registration to each other.

The digital printing systems having one or more printheads that selectively moisten at least a portion of the print media as described above include a media transport system that serves as a support structure to guide the continuous web of print media. The support structure includes an edge guide or other mechanism that positions the print media in the cross track direction. This first mechanism is located upstream of the printheads of the digital printing system. The print media is pulled through the digital printing system by a driven roller that is located downstream of the printheads. The systems also include a mechanism located upstream of printheads of the printing system for establishing and setting the tension of the print media. Typically it is also located downstream of the first mechanism used for positioning the print media in the cross track direction. The transport system also includes a third mechanism to set an angular trajectory of the print media. This can be a fixed roller (for example, a non-pivoting roller) or a second edge guide. The printing system also includes a roller affixed to the support structure, the roller being configured to align to the print media being guided through the printing system without necessarily being aligned to another roller located upstream or downstream relative to the roller. The castered, gimbaled or castered and gimbaled rollers serve in this manner.

The invention has been described in detail with particular reference to certain preferred embodiments thereof, but it will be understood that variations and modifications can be effected within the scope of the invention. For example, additional sensors can be provided in order to detect pivoting or other mechanical bias of media guides 106 and 108.

PARTS LIST

10. Printing system
12. Source roller
14. Dryer
16. Digital printhead
18. Take-up roll
20. Module
22. Cross-track positioning mechanism
24. Tensioning mechanism
26. Constraint structure
28. Support structure
30. Turnover mechanism
32. Drive roller
34, 36. Turn bar
40. Module
48. Support structure
50. Digital printing system
52. Slack loop
54. Print zone
60. Web
62. Edge (support structure)
64. Lateral constraint
66. Angular constraint
68 Zero constraint
70. Entrance module
72. Printhead module
74. End feed module
76. Forward feed module
78. Printhead module
80. Out-feed module
90. Control logic processor
100. Edge guide
102. Web substrate
104. Mounting structure
106. Fixed media guide
108. Compliant media guide
110. Ribs
112. Support beam
114. Motor
116. Adjustment apparatus
120. Lead-screw translation mechanism
122, 124. Sensor
130. Edge guide
132. Urging mechanism
134. Leadscrew
136. Mounting structure
140. Control logic processor
142. Control panel
144. Sensor
150. Control loop
A. Edge guide
CL. Center line
C1, C2. Centroid
E1. Aligning edge
Q. Nesting force
O1. Opposite edge
B, C, D, E, F, G, H, I, J, K, L, M, N, O, P. Rollers,
SW. S-wrap
TB. Turnover module

The invention claimed is:

1. An edge guide for positioning an edge of a print media in a direction that is lateral relative to a direction of print media travel comprising:

a structure including curved surface over which a print media can travel, the print media including a first edge and a second edge that is opposite the first edge;

a first media guide that is contactable with the first edge of the print media;

a second media guide that is contactable with the second edge of the print media, the second media guide being spaced apart from the first media guide;

a first adjustment mechanism that adjusts the relative spacing between the second media guide and the first media guide such that a distance between the first media guide and the second media guide is variable to accommodate different print media widths; and a second adjustment mechanism that during operation moves the second media guide in the lateral direction relative to the print media travel direction to apply a nesting force through the second media guide to the second edge of the print media continuously urging the first edge of the print media toward the first media guide to contact the first media guide, the first edge guide being constrained in the lateral direction relative to the print media travel direction during the operation of the second adjustment mechanism, the first adjustment mechanism and the second adjustment mechanism being independently operable with respect to each other.

2. The edge guide of claim 1, wherein the first media guide is pivotally mounted relative to the curved surface.

3. The edge guide of claim 2, wherein the first media guide is pivotally mounted relative to the curved surface at a pivot point that allows two degrees of rotational freedom.

4. The edge guide of claim 3, wherein the pivot point is located substantially at a centroid of the print media edge contactable with the first media guide.

5. The edge guide of claim 2, wherein the first media guide is pivotally mounted relative to the curved surface at a pivot that is located substantially at a centroid of the print media edge contactable with the first media guide.

6. The edge guide of claim 1, wherein the second media guide is pivotally mounted relative to the curved surface.

7. The edge guide of claim 6, wherein the second media guide is pivotally mounted relative to the curved surface at a pivot point that allows three degrees of freedom.

8. The edge guide of claim 7, wherein the pivot point is located substantially at a centroid of the print media edge contactable with the second media guide.

9. The edge guide of claim 7 wherein the nesting force is applied at the pivot point.

10. The edge guide of claim 6, wherein the second media guide is pivotally mounted relative to the curved surface at a pivot that is located substantially at a centroid of the print media edge contactable with the second media guide.

11. The edge guide of claim 1, the spacing between the second media guide and the first media guide including a center line, wherein adjustment of the relative spacing between the second media guide and the first media is accomplished such that the center line between the first media guide and the second media guide remains substantially fixed.

12. The edge guide of claim 1, wherein the curved surface of the structure includes a plurality of segments.

13. The edge guide of claim 12, the plurality of segments including a first end portion, a center portion, and a second end portion, wherein the center portion is fixed and the first end portion and the second end portion are moveable relative to the fixed center portion.

14. The edge guide of claim 12, wherein the position of at least one of the plurality of segments is adjustable.

15. The edge guide of claim 12, further comprising:

a second surface positioned behind the curved surface over which the print media can travel, the second surface spanning the distance between the first media guide and the second media guide.

16. The edge guide of claim 1, wherein at least one of the first media guide and the second media guide includes a sensor configured to sense contact of the print media with the first media guide.

17. The edge guide of claim 1, wherein at least one of the first media guide and the second media guide includes a sensor configured to sense the relative spacing between the first media guide and the second media guide.

18. The edge guide of claim 1, wherein the mechanism that applies the force to the second edge of the print media applies a constant force to the edge of the second edge of the print media.

19. The edge guide of claim 1, wherein the mechanism that applies the force to the second edge of the print media applies a selectable magnitude constant force to the edge of the second edge of the print media.

20. The edge guide of claim 19, wherein the selectable magnitude constant force is manually adjustable.

21. The edge guide of claim 19, wherein the selectable magnitude constant force is automatically adjusted in response to operator input.

22. The edge guide of claim 21, wherein operator input includes a characteristic of the print media.

23. The edge guide of claim 19, wherein the selectable magnitude constant force is automatically adjusted based at least in part on a sensed characteristic of the print media.

24. The edge guide of claim 1, wherein the relative spacing between the second media guide and the first media guide is manually adjustable.

25. The edge guide of claim 1, wherein the relative spacing between the second media guide and the first media guide is automatically adjusted in response to operator input.

26. The edge guide of claim 25, wherein operator input includes a characteristic of the print media.

27. The edge guide of claim 1, wherein the relative spacing between the second media guide and the first media guide is automatically adjusted based at least in part on a sensed characteristic of the print media.

28. The edge guide of claim 1, wherein at least one of the first media guide and the second media guide include a surface that has a low coefficient of friction and a high abrasion resistance.

29. The edge guide of claim 28, wherein the surface includes a polytetrafluoroethylene (PTFE) impregnated nickel coating.

30. A method of printing on a continuous web of print media comprising:

providing an edge guide structure for positioning an edge of a print media in a direction that is lateral relative to a direction of print media travel, the edge guide including:

a curved surface over which a print media can travel, the print media including a first edge and a second edge that is opposite the first edge;

a first media guide that is contactable with the first edge of the print media;

a second media guide that is contactable with the second edge of the print media, the second media guide being spaced apart from the first media guide;

a first adjustment mechanism that adjusts the relative spacing between the second media guide and the first media guide such that a distance between the first media guide and the second media guide is variable to accommodate different print media widths; and a second adjustment mechanism that during operation moves the second media guide in the lateral direction relative to the print media travel direction to apply a nesting force through the second media guide to the second edge of the print media continuously urging the first edge of the print media toward the first media guide to contact the first media guide, the first edge guide being constrained in the lateral direction relative to the print media travel direction during the operation of the second adjustment mechanism, the first adjustment mechanism and the second adjustment mechanism being independently operable with respect to each other;

optionally adjusting the relative spacing between the second media guide and the first media guide using the first adjustment mechanism to accommodate different widths of the print media;

causing the print media to travel through the edge guide structure;

applying a nesting force to the second edge of the print media to cause the first edge of the print media to move toward and contact the first media guide using the second adjustment mechanism associated with the second media guide as the print media travels through the structure.

31. The method of claim 30, further comprising:

selectively placing marks on the print media after it travels through the edge guide structure using a digital printhead located in at least one of the first module and the second module.

* * * * *